US010128572B2

(12) United States Patent
Caratelli et al.

(10) Patent No.: US 10,128,572 B2
(45) Date of Patent: Nov. 13, 2018

(54) PATCH ANTENNA, METHOD OF MANUFACTURING AND USING SUCH AN ANTENNA, AND ANTENNA SYSTEM

(71) Applicant: The Antenna Company International N.V., Curaçao (CW)

(72) Inventors: Diego Caratelli, Duizel (NL); Johan Leo Alfons Gielis, Antwerpen (BE); Vasiliki Paraforou, Delft (NL); Luciano Mescia, Trigianno (IT); Pietro Bia, Matera (IT)

(73) Assignee: The Antenna Company International N.V., CW Willemstad (CW)

( * ) Notice: Subject to any disclaimer, the term of this patent is extended or adjusted under 35 U.S.C. 154(b) by 0 days.

(21) Appl. No.: 15/129,092

(22) PCT Filed: Feb. 3, 2015

(86) PCT No.: PCT/NL2015/050070
§ 371 (c)(1),
(2) Date: Sep. 26, 2016

(87) PCT Pub. No.: WO2015/147635
PCT Pub. Date: Oct. 1, 2015

(65) Prior Publication Data

US 2017/0222321 A1 Aug. 3, 2017

(30) Foreign Application Priority Data

Mar. 26, 2014 (WO) ..... PCT/NL2014/050188

(51) Int. Cl.
*H01Q 9/04* (2006.01)
*H01Q 1/48* (2006.01)
(Continued)

(52) U.S. Cl.
CPC ..... *H01Q 9/0407* (2013.01); *H01Q 1/48* (2013.01); *H01Q 9/0485* (2013.01);
(Continued)

(58) Field of Classification Search
CPC ..... H01Q 9/0407; H01Q 5/25
See application file for complete search history.

(56) References Cited

U.S. PATENT DOCUMENTS 4,844,144 A 7/1989 Murphy et al.
4,864,520 A 9/1989 Setoguchi et al.
(Continued)

OTHER PUBLICATIONS

International Search Report and the Written Opinion for corresponding International Application No. PCT/NL2015/050070 dated May 18, 2015.
(Continued)

*Primary Examiner* — Jessica Han
*Assistant Examiner* — Amal Patel
(74) *Attorney, Agent, or Firm* — Renner, Otto, Boisselle & Sklar, LLP

(57) ABSTRACT

The invention relates to a patch antenna. The invention also relates to an antenna system for transmitting and receiving electromagnetic signals comprising at least one antenna according to the invention. The invention further relates to a method of manufacturing an antenna according to the invention. The invention moreover relates to a method for use in wireless communications by using an antenna according to the invention. The invention additionally relates to a RF transceiver of a wireless communications device comprising at least one antenna according to the invention. The invention further relates to an electronic device comprising an RF transceiver according to the invention.

19 Claims, 17 Drawing Sheets

(51) Int. Cl.

| | |
|---|---|
| ***H01Q 13/10*** | (2006.01) |
| ***H01Q 21/06*** | (2006.01) |
| ***H01Q 9/28*** | (2006.01) |
| *H01Q 19/10* | (2006.01) |

(52) U.S. Cl.
CPC ..... *H01Q 9/285* (2013.01); *H01Q 13/10* (2013.01); *H01Q 21/065* (2013.01); *H01Q 9/0464* (2013.01); *H01Q 19/108* (2013.01)

(56) References Cited

U.S. PATENT DOCUMENTS

| | | | |
|---|---|---|---|
| 4,942,001 | A | 7/1990 | Murphy et al. |
| 5,059,021 | A | 10/1991 | Spence et al. |
| 5,130,064 | A | 7/1992 | Smalley et al. |
| 5,143,663 | A | 9/1992 | Leyden et al. |
| 5,159,512 | A | 10/1992 | Evans et al. |
| 5,167,882 | A | 12/1992 | Jacobine et al. |
| 5,182,055 | A | 1/1993 | Allison et al. |
| 5,182,056 | A | 1/1993 | Spence et al. |
| 5,182,715 | A | 1/1993 | Vorgitch et al. |
| 5,184,307 | A | 2/1993 | Hull et al. |
| 5,217,653 | A | 6/1993 | Mashinsky et al. |
| 5,236,637 | A | 8/1993 | Hull |
| 5,247,180 | A | 9/1993 | Mitcham et al. |
| 5,256,340 | A | 10/1993 | Allison et al. |
| 5,296,335 | A | 3/1994 | Thomas et al. |
| 5,398,193 | A | 3/1995 | deAngelis |
| 5,458,825 | A | 10/1995 | Grolman et al. |
| 5,491,643 | A | 2/1996 | Batchelder |
| 5,547,305 | A | 8/1996 | Treche |
| 5,578,227 | A | 11/1996 | Rabinovich |
| 5,587,912 | A | 12/1996 | Andersson et al. |
| 5,587,913 | A | 12/1996 | Abrams et al. |
| 5,609,812 | A | 3/1997 | Childers et al. |
| 5,609,813 | A | 3/1997 | Allison et al. |
| 5,616,293 | A | 4/1997 | Ashtiani-Zarandi et al. |
| 5,622,577 | A | 4/1997 | O'Connor |
| 5,639,413 | A | 6/1997 | Crivello |
| 5,663,883 | A | 9/1997 | Thomas et al. |
| 5,711,911 | A | 1/1998 | Hull |
| 5,728,345 | A | 3/1998 | Hlavaty et al. |
| 5,796,620 | A | 8/1998 | Laskowski et al. |
| 5,796,986 | A | 8/1998 | Fuller |
| 5,818,718 | A | 10/1998 | Thomas et al. |
| 5,846,370 | A | 12/1998 | O'Connor |
| 5,880,962 | A | 3/1999 | Andersson et al. |
| 7,620,527 | B1 | 11/2009 | Gielis |
| 2012/0002388 | A1* | 1/2012 | Utagawa ..... H01Q 9/285 361/782 |
| 2012/0041728 | A1* | 2/2012 | Gielis ..... G06F 17/14 703/2 |

OTHER PUBLICATIONS

International Preliminary Report on Patentability for corresponding International Application No. PCT/NL2015/050070 dated Jun. 6, 2016.

Vasiliki Paraforou, "Design and full-wave analysis of supershaped patch antennas", Master of Science Thesis, Nov. 2013.

Bertsch et al., "Study of the spatial resolution of a new 3D microfabrication process: the microstereophotolithography using a dynamic mask-generator technique," Journal of Photochemical and Photobiol. A: Chemistry, vol. 107, 1997, pp. 275-281 (cited in specification on pp. 25-26).

* cited by examiner

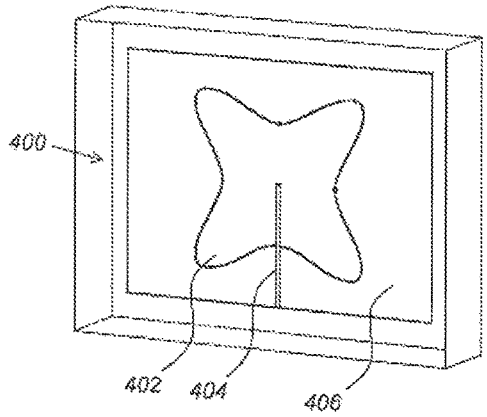
Fig. 15A
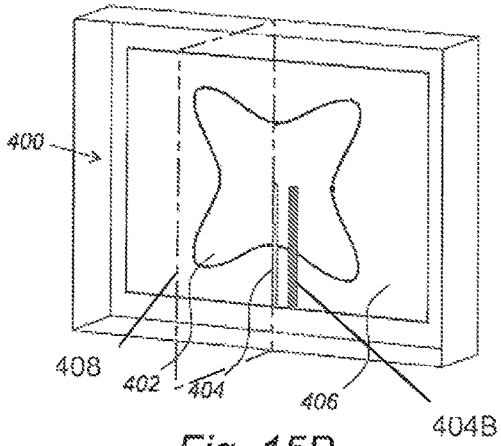
Fig. 15B
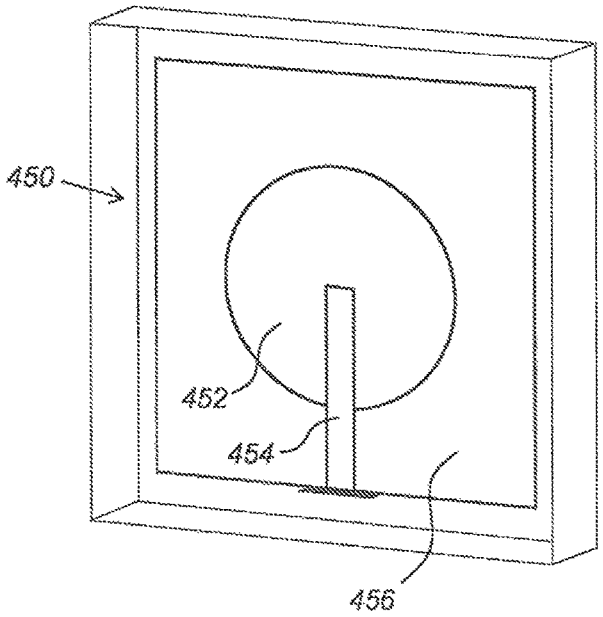
Fig. 16 - CONVENTIONAL ART

PATCH ANTENNA, METHOD OF MANUFACTURING AND USING SUCH AN ANTENNA, AND ANTENNA SYSTEM

This application is a national phase of International Application No. PCT/NL2015/050070 filed Feb. 3, 2015 and published in the English language, which claims priority to International Application No. PCT/NL2014/050188 filed Mar. 26, 2014.

The invention relates to a patch antenna. The invention also relates to an antenna system for transmitting and receiving electromagnetic signals comprising at least one antenna according to the invention. The invention further relates to a method of manufacturing an antenna according to the invention. The invention moreover relates to a method for use in wireless communications by using an antenna according to the invention. The invention additionally relates to an RF transceiver of a wireless communications device comprising at least one antenna according to the invention. The invention further relates to an electronic device comprising an RF transceiver according to the invention.

The present invention improves upon the subject matter disclosed in U.S. Pat. No. 7,620,527 issued on Nov. 17, 2009 to a present inventor, Johan Gielis, the entire contents of which Patent is incorporated herein by reference as though recited herein in full. In addition, the present invention also incorporates by reference the entire disclosure of U.S. Provisional Application No. 61/356,836 entitled Computer Implemented Tool Box to Johan Gielis, filed on Jun. 21, 2010, the entire contents of which is incorporated herein by reference as though recited herein in full. Furthermore, the present application also incorporates by reference the entire disclosure of U.S. patent application Ser. No. 13/165,240 entitled Computer Implemented Tool Box to Johan Gielis, filed on Jun. 22, 2011, the entire contents of which is incorporated herein by reference as though recited herein in full.

The '527 Patent describes systems and methods by which patterns (e.g., such as images, waveforms such as sounds, electromagnetic waves, or other signals, etc.) are synthesized, modulated and/or analyzed through the use of a computer programmed with a novel mathematical formula. The formula can be used to create a variety of shapes, waveforms, and other representations. The formula greatly enhances ability in computer operations and provides a great savings in computer memory and a substantial increase in computing power.

The geometric concept of the '527 patent is useful for modeling and for explaining why certain natural shapes and forms grow as they do. As explained in the '527 patent, the inventor therein found that most geometrical forms and regular shapes, including circles and polygons, can be described as special realizations of the following formula:

$$\rho_d(\varphi) = \frac{1}{\sqrt[n_1]{\left|\frac{1}{a}\cos\frac{m_1}{4}\varphi\right|^{n_2} + / - \left|\frac{1}{b}\sin\frac{m_2}{4}\varphi\right|^{n_3}}}$$

$$a, b \in \mathbb{R}^+; m_1, m_2, n_1, n_2, n_3 \in \mathbb{R}, a, b, n_1 \neq 0$$

The '527 patent explains how this formula and representations thereof can be utilized, for example, in both the "synthesis" and "analysis" of patterns (i.e., including for example image patterns and waveforms such as electromagnetic (e.g., electricity, light, etc.), sound and other waveforms or signal patterns) and the like.

In order to synthesize various patterns, the parameters in this equation can be modified so that a variety of patterns can be synthesized. Notably, the parameters appearing in the equations above can be moderated. By moderating or modulating the number of rotational symmetries (m), exponents ($n_1$-$n_3$), and/or short and long axes (a, b), a wide variety of natural, human-made and abstract shapes can be created in two and three-dimensional space.

In FIG. 1 of the '527 patent a schematic diagram is shown showing various components that can be included in various embodiments for the synthesis of patterns and/or for the analysis of patterns with the super-formula operator. As described in the '527 patent, according to the first aspect, for illustrative purposes with reference to said FIG. 1, shapes or waves can be "synthesized" by the application of the following exemplary basic steps: In a first step, a choice of parameters is made (e.g., by either inputting values into the computer 10, i.e., via a keyboard 20, a touch screen, a mouse-pointer, a voice recognition device or other input device or the like, or by having the computer 10 designate values), and the computer 10 is used to synthesize a selected super-shape based on the choice of parameters. In a second optional step, the super-formula can be used to adapt the selected shapes, to calculate optimization, etc. This step can include use of: graphics programs (e.g., 2D, 3D, etc.); CAD software; finite element analysis programs; wave generation programs; or other software. In a third step, the output from the first or second step is used to transform the computerized super-shapes into a physical form, such as via: (a) displaying the super-shapes 31 on a monitor 30, printing the super-shapes 51 upon stock material 52 such as paper from a printer 50 (2-D or 3-D); (b) performing computer aided manufacturing (e.g., by controlling an external device 60, such as machinery, robots, etc., based on the output of step three); (c) generating sound 71 via a speaker system 70 or the like; (d) performing stereo lithography; (e) performing rapid prototyping; and/or (f) utilizing the output in another manner known in the art for transforming such shapes.

The '527 patent discusses both synthesis (such as, e.g., creation of shapes) and analysis (such as, e.g., the analysis of shapes). With respect to analysis, the '527 patent explains that: "In general, although not limited thereto, shapes or waves can be "analyzed" by the application of the following basic steps (these steps have similarities to the foregoing steps in synthesis in reverse): In a first step, a pattern can be scanned or input into a computer (e.g., in a digital form). For example, an image of an object can be scanned (2-D or 3-D), a microphone can receive sound waves, or electrical signals (e.g., waves) can be input, data from a computer readable medium such as, e.g., a CD-ROM, a diskette, an internal or external flash drive, etc., can be input, data can be received on-line, such as via the Internet or an Intranet, etc. Various other known input techniques could be used, such as, for example, using digital or other cameras (e.g., whether single picture or continuous real time, etc.), etc. [FIG. 1] illustrates examples wherein an image scanner 100 (e.g., a document scanner utilized to scan images on stock material such as paper or photographs, or another scanner device) and/or a recorder 200 (e.g., which receives waveforms via a microphone or the like) are utilized in conjunction with the computer 10. In a second step, the image is analyzed to determine parameter values, etc., of the super-formula. In this step, the analyzed signals could also be identified, categorized, compared, etc. In some computer analysis cases, the computer can include a library or catalogue (e.g., stored in a memory) of primitives (e.g., categorizing assorted supershapes by parameter values). In such latter cases, the computer can then be used to approximate, identify, classify and/or the like the supershapes based on the information in the library or catalogue. The catalogue of primitives could be used, for example, for the first approximation of patterns or shapes. In a third optional step, the analyzed signals can be moderated as desired (e.g., operations can be performed similar to that described above with reference to the second general phase or step of synthesis).

In a fourth step, an output can be created. The output can include: (a) providing a visual (e.g., displayed or printed) or an audible (e.g., sound) output; (b) controlling the operation of a particular device (e.g., if certain conditions are determined); (c) providing an indication related to the analyzed pattern (e.g., identifying it, classifying it, identifying a preferred or optimal configuration, identifying a defect or abnormality, etc.); (d) creating another form of output or result as would be apparent to those in the art. In the analysis, after the pattern is digitized, the computer proceeds using a certain type of representation. If it is a chemistry pattern, the XY graph should be selected. If it is a closed shape, a modified Fourier analysis should be selected. The computer should be adapted (e.g., via software) to provide an estimation of the right parameters for the equation to represent the digitized pattern.

Although the '527 patent sets forth noteworthy advances in technology, over the last decade, the present inventors have surprisingly discovered some noteworthy advances and improvements which are the subject matter of the present application.

An object of some embodiments of the invention is to find a class of products in which the above technology is implemented in a beneficiary manner.

In the preferred embodiments of the invention, improved patch antennas, in particular patch antennas, for a wide class of wireless applications (including Wi-Fi networks) are invented. This improved patch antenna, in particular a patch antenna, comprises: at least one electrically conductive patch, at least one electrically conductive ground plane, at least one feed connector which is insulated from the ground plane and which is conductively connected to at least one patch, and at least one dielectric spacer structure for separating the at least one patch and the at least one ground plane, wherein at least one patch is defined by at least a part of at least one base profile which is substantially supershaped, wherein said supershaped base profile is defined by the polar function:

$$\rho_d(\varphi) = \left(\left|\frac{1}{a}\cos\frac{m_1}{4}\varphi\right|^{n_2} + \left|\frac{1}{b}\sin\frac{m_2}{4}\varphi\right|^{n_3}\right)^{-\frac{1}{n_1}}$$

wherein:

$\rho_d(\varphi)$ is a curve located in the XY-plane, $\varphi \in [0, 2\pi)$ is the angular coordinate, $m1 \neq 0$ and $m2 \neq 0$, and wherein at least one of n1, n2, and n3 does not equal 2.

In the above definition, preferably $n1=n2=n3 \neq 2$.

Despite of the fact that the proposed antennas are extremely simple to construct, easily machinable and thus cheap, they surprisingly considerably outperform antennas currently used in wireless communications in terms of operational bandwidth, maximum gain (both a good efficiency and a good directivity), and radiation pattern agility. These outstanding properties are in particularly due to the special geometry of the base profile of the patch and/or the ground plane, being defined by the polar equation known in the scientific literature as superformula (or Gielis' formula) and its generalization to three-dimensional spaces. The superformula is explained in detail in the above-noted U.S. Pat. No. 7,620,527 to J. Gielis, the entire disclosure of which is incorporated herein by reference. Such equation provides the capability for unified description of natural and abstract shapes ranging from elementary particles to complex generalized Lame curves. The invented antenna allows an increased number of degrees of freedom for the design, paving the way towards a wide variety of radiating structures and sensors with tunable electromagnetic characteristics.

In fact, every patch antenna according to the invention comprises a patch and/or ground plane having a three-dimensional shape, despite of the fact that both the patch and the ground plane commonly have a limited height. By providing at least one base profile of the patch and possibly also of the ground plane a supershape wherein each supershaped base profile is defined by the polar function (superformula) according to claim 1, a novel compact (portable) antenna with simple topology and unique architecture is realized, having, moreover, an outstanding performance in comparison with known patch antennas.

Preferably, in the design of a supershaped patch antenna, the effective radius of the patch is defined as:

$$\rho_e = \sqrt{\frac{1}{2\pi}\int_0^{2\pi}\rho_d^2(\varphi)d\varphi}$$

where $\rho_d(\varphi)$ is given by the Gielis' equation:

$$\rho_d(\varphi) = \left(\left|\frac{1}{a}\cos\frac{m_1}{4}\varphi\right|^{n_2} + \left|\frac{1}{b}\sin\frac{m_2}{4}\varphi\right|^{n_3}\right)^{-\frac{1}{n_1}}$$

In order to achieve a wide band of operation, the distance between the ground plane and the at least one patch ($h_d$) is chosen to be about, depending on the antenna structure, ⅛ or ¼ wavelength at the central operating frequency of the antenna ($f_c$), that is:

$$\lambda_d = \frac{c_0}{f_c\sqrt{\varepsilon_r}}$$

with $c_0$ being the speed of light in vacuum, and where $\varepsilon_r$ denotes the relative permittivity of the dielectric material of the spacer structure. In order to properly tune the antenna resonant frequency, the cross-sectional dimensions of the patch structure are set so that the following aspect ratio is obtained:

$$\chi = \frac{\rho_e}{\lambda_d} = 0.5$$

The location and geometry of the probe are heuristically determined by full-wave analysis.

The patch antenna according to the invention is lightweight, inexpensive, and easy to integrate with accompanying electronics. Since the patch(es) used in the antenna according to the invention are commonly substantially flat, the patch antenna is also often referred to as a planar antenna. However, it is imaginable that the at least one patch, and even the antenna as such, has a 3D geometry, in particular curved and/or hooked, rather than a 2D flat geometry. For instance, the patch can be wrapped around the spacer structure and/or the antenna as such may be wrapped or wound around an object. In this case, both the ground plane and the space structure will have a 3D geometry. Hence, the antenna according to the invention could be a 3D antenna.

Since the at least one patch used in the antenna is commonly printed (or otherwise deposited) onto the spacer structure, the patch antenna is also often referred to as a printed antenna. However, it is thinkable that one or more patches of the antenna are prefabricated and subsequently attached to the spacer structure, for example by gluing or mechanical clamping.

The patch antenna according to the invention, preferably comprises multiple patches, each of which is preferably connected to a separate feed connector. As such, the patch antenna can be further adapted to the most favourable configuration in terms of gain and radiation pattern. Separate feed connectors allow for a differentiation between the patches in terms of the voltages applied as well as the timing thereof. Furthermore, it is preferred that the multiple patches of the patch antenna according to the invention are positioned at a distance from each other.

It is preferred in the patch antenna according to the invention, that each patch has a base profile which is substantially supershaped. This further enhances the beneficial effects of the patches on the patch antenna as a whole.

In a further preferred embodiment of the patch antenna according to the invention, it comprises the at least one patch connected to the feed connector acting as primary patch, wherein the patch antenna further comprises at least one secondary patch positioned at a distance from said primary patch, such that primary patch and secondary patch are configured to interact electromagnetically with another. In this configuration, an activation of the primary patch via the connector feed, will establish a subsequent activation of the secondary patch by resonance. As each patch has its own distinct electromagnetic character, the patch antenna is capable of transmitting and receiving at two different frequencies (dual-band capability).

The above dual-band capability of the patch antenna according to the invention is further enhanced, when the set of the at least one primary patch and the at least one secondary patch has a combined base profile which is substantially supershaped. The contribution of the supershape to the patch antenna has already been explained above.

The patch antenna having dual-band capability according to the invention, comprises by further preference at least one primary patch and the at least one secondary patch which are mutually separated by at least one slot, wherein said at least one slot has a base profile which is substantially supershaped. It has been found that a supershaped base profile of the slot further enhances the advantageous features of the patch antenna. At least one, and preferable both, of the primary patch and secondary patch has a base profile which is substantially supershaped (by using the superformula). However, it is also imaginable that the assembly of the primary patch and secondary patch has an (overall) base profile which is substantially supershaped (by using the superformula). Furthermore, the patch antenna having dual-band capability according to the invention, comprises preferably at least one primary patch and at least one secondary patch which are mutually separated by at least one slot, which slot has a substantially constant width, preferably in the range of 4 up to 6 mm. Experiments have shown that the frequency response of the patch antenna is dependent on the gap width. One example of an optimum gap width for a patch antenna which operates very well in two frequency bands is 5 millimeter.

A preferred embodiment of the patch antenna having dual-band capability according to the invention, comprises at least one primary patch which at least partially encloses at least one secondary patch.

A special preferred embodiment of the patch antenna having dual-band capability according to the invention, comprises at least one secondary patch which at least partially, preferably completely, encloses at least one primary patch. Radiation efficiency and gain are remarkably high for such a configuration of patches.

Preferably, the patch antenna according to the invention contains at least one patch which is provided with at least one cut-away. In this way, the patch antenna can be adapted to specific requirements in terms of gain, radiation efficiency, and possibly a multiple frequency capability.

Advantageously, the patch antenna according to the invention comprises a spacer structure that comprises a substrate comprising at least one dielectric substrate layer, said substrate being positioned in between the ground plane and the at least one patch. Such a structural built-up is most convenient in terms of producing the patch antenna, as well as in terms of durability and miniaturization of the patch antenna. In a particular advantageous embodiment, the dielectric substrate layer makes part of a printed circuit board (PCB), having the same advantages as above. The dielectric spacer structure, and in particular the at least one substrate layer, may also be made of a other dielectric materials such of glass, in particular Pyrex® (a clear, low-thermal-expansion borosilicate glass commercially available from Corning Incorporated), crystal, silica (silicon dioxide), ferroelectric dielectric materials, liquid crystals, at least one polymer, in particular polyvinylchloride (PVC), polystyrene (PS), polyimide (PI), a bioplastic (a plastic derived from renewable biomass sources, such as vegetable fats and oils, corn starch, pea starch or microbiota), or fluoroplastics; and/or a metal oxide, in particular titanium oxide, aluminium oxide, barium oxide, or strontium oxide. In particular, the application will commonly be prepared both from a financial point of view and from a design point of view. Polymers are relatively cheap, and moreover easy to shape using conventional moulding, extrusion and/or thermoforming techniques, and can even be shaped by way of 3D printing which provides a significant freedom of design. In this context, in some embodiments one can apply a spacer structure comprising a shell which is at least partially made of at least one glass, crystal, and/or at least one polymer enclosing at least one inner space which is at least partially filled with a fluid, preferably air or demineralised water (acting as dielectric). The application of air and water will reduce the quantity of other materials used which will further reduce the cost price of the spacer structure and therefore of the antenna according to the invention. It is also imaginable that at least a part of the spacer structure has a substantially U-shaped structure for supporting the ground plane and carrying the at least one patch, wherein an air gap is situated in between the ground plane and the at least one patch. The presence of merely air would also work as dielectric. In case an intermediate substrate would be used as part of the spacer structure, said substrate being situated in between the ground plane and the at least one patch, said substrate could consist of a laminate of multiple substrate layers, such as a core layer, an absorber layer, a reflective layer, etc. By composing the substrate of multiple layers, the overall properties could be optimized more easily.

In a preferred embodiment of the patch antenna according to the invention, the parameter m in the polar function fulfils the condition $m \geq 1$. This parameter condition leads to unconventional symmetric shape of the patch including sharp edges which results in a more symmetric spatial power density distribution if compared to the case of a cylindrically shaped patch ($m=0$). In this manner, electromagnetic radiation can be radiated in multiple focused directions. The presence of sharp edges does necessarily not reduce the radiation efficiency of the preferred antenna. A further preferred boundary condition is that $a \neq b$. Also these boundary conditions lead to unconventionally shaped patch, in particular when n1 is approx. 0.5, n2 is approx. 1.0, and n3 is approx. 1.0.

In a further preferred embodiment of the patch antenna according to the invention, at least one patch has a base profile which is symmetrical with respect to x- and y-axis by which the plane of the patch is defined. Such a patch antenna shows a relatively low degree of cross-polarization.

In a next preferred embodiment of the patch antenna according to the invention, multiple patches have their respective feed connectors connected at symmetrical positions. Such a configuration enhances the polarization purity of the antenna.

In a further preferred embodiment of the patch antenna according to the invention, at least one patch has a base profile which has a substantially rounded circumferential edge. Such a configuration further reduces the cross-polarization levels of the antenna.

In a another preferred embodiment of the patch antenna according to the invention, at least one patch has a base profile which has a substantially convex circumferential edge. Such a configuration makes the antenna more suitable for miniaturization and bandwidth enhancement.

Preferably, in the patch antenna according to the invention, the spacer structure and/or the ground plane has a substantial circular or elliptical shape, wherein preferably the substrate layer and ground plane are substantially congruent. Such a configuration can be conveniently produced, and is suitable for miniaturization.

By further preference, the patch antenna according to the invention comprises a feed connector which is connected to a selective feed location. This feed location is selected heuristically in order to achieve good impedance matching with the input transmission line, while exciting the desired (fundamental) resonant mode of the antenna which results in a directional radiation of the power injected at input terminals of the antenna.

In the patch antenna according to a preferred embodiment of the invention, the patch is a sheet substantially made out of an electrically conductive metal, preferably out of copper, silver and/or gold. These materials have proven to be highly suitable for the patch antenna in terms of its function as a transceiver.

Further preferred suitable dimensions of the features of the patch antenna are:

- The patch having a thickness of between 1 and 10 micrometer, preferably between 3 and 4 micrometer, more preferably about 3.5 micrometer;
- The major surface of the patch having a size of between 2 and 100 cm2;
- The distance between facing surfaces of the patch and the ground plane being between 2 and 20 millimeter;
- The size of a major surface of the ground plane facing the patch having a size of one wavelength by one wavelength at the lowest operating frequency.

By further preference, the base profile of the patch of the patch antenna according to the invention, extends in a direction which is substantially parallel to a plane defined by the ground plane. This will commonly lead to an axis of symmetry of the patch which is oriented perpendicular to a (central) plane defined by the ground plane which is in favour of the spatial power density distribution.

Advantageously, the patch antenna according to the invention, comprises a patch that is configured to receive and/or transmit electromagnetic radiation. This makes it possible that the antenna according to the invention can be used to receive and/or to transmit electromagnetic radiation. The functionality of the at least one feed connector therefore depends on the desired functionality of the antenna. It is thus thinkable that the feed connector is configured to receive and/or to transmit electromagnetic radiation. Commonly, the feed comprises at least one probe. The geometry, including the shape and dimensioning, of the feed connector is commonly completely dependent on the specific purpose and application of the antenna. Different types of feed connectors can be used. A well known feed connector is a microstrip which is attached, commonly by deposition, onto a surface of the spacer structure (substrate). Another option is that the feed connectors is a coaxially fed probe, which probe is at least partially accommodated within the spacer structure and extending through a hole provided in the ground plane. To this end, the spacer structure is commonly provided with an accommodating space for accommodating the probe at least partially.

In case a single feed connector and a single patch are used in the patch antenna, the antenna will be suitable to operate within a single designated frequency band. The frequency range of said frequency band completely depends on the application of the antenna. Currently, many mobile communication systems use several frequency bands such as GSM 900/1800/1900 bands (890-960 MHz and 1710-1990 MHz); Universal Mobile Telecommunication Systems (UMTS) and UMTS 3G expansion bands (1900-2200 MHz and 2500-2700 MHz); frequency bands in the microwave spectrum (1-100 GHz), in particular the Ka band (26.5-40 GHz) and the Ku band (12-18 GHz) used for satellite communication; and Wi-Fi (Wireless Fidelity)/Wireless Local Area Networks (WLAN) bands (2400-2500 MHz and 5100-5800 MHz), and different radio related bands between 9000 and 10000 MHz, and Ground Penetrating Radar frequency bands (0.4-4.5 GHz). The patch antenna according to preferred embodiments of the invention is, however, not limited to the abovementioned enumeration of well-known frequency bands.

Conventionally, because a single antenna having a single patch cannot operate at all of these frequency bands of mobile communication, multiple different antennas covering these bands separately could be used. However, usage of many antennas is usually limited by the volume and cost constraints of the applications. Therefore, multiband and wideband antennas are essential to provide multifunctional operations for mobile communication. A multiband antenna in a mobile communication system can be defined as the antenna operating at distinct frequency bands, but not at the intermediate frequencies between bands. To this end, it is preferred that the antenna according to the invention comprises multiple patches, wherein at least two patches are connected to their own feed connector, such that the patches can be controlled independently from each other. Moreover, additional patches which are not directly connected to a feed connector, though which are configured to interact electromagnetically during operation with an actively powered patch, could also be very useful to allow the antenna to operate in a desired frequency band.

The ground plane is at least partially made of metal or any other electrically conductive material. Commonly, this ground plane is made of a metal disc, a metal screen (foil), or a metal coating.

In preferred embodiments, the antenna comprises at least one processor to automatically switch the feed connector (probing structure) between a radiation transmitting mode and a radiation receiving mode for two-way communication of the feed connector. More particularly, the processor is preferably configured to automatically switch between the first frequency band and the second frequency band for two-way communication in each frequency band.

Preferably, in the patch antenna according to the invention at least one patch is configured to operate in a broad frequency range which ranges from 0.5 up to 4 GHz, or from 2 to 20 GHz, or from 0.5 up to 20 GHz. Such patch antennas allow for ultra wide band (UWB) applications.

Within the context of the invention, especially preferred patch antennas for ultra wide band applications are the following:

i)

A patch antenna wherein at least one patch is configured to operate in a broad frequency range which ranges from 2 GHz to 20 GHz, and wherein that patch is defined by the polar function:

$$\rho_d(\varphi) = \left(\left|\frac{1}{a}\cos\frac{m_1}{4}\varphi\right|^{n_2} + \left|\frac{1}{b}\sin\frac{m_2}{4}\varphi\right|^{n_3}\right)^{-\frac{1}{n_1}}$$

wherein:

m1 equals m2 and ranges from 1 to 3.5;
a=b=1;
n3 equals n2 and ranges from 0.7 to 3; and
n1 ranges from 0.5 to 3,
and more specifically wherein:
m1 equals m2 and ranges from 1 to 3.5;
a=b=1;

combined with either:

n1=3 while n3 equals n2 and is chosen from 3, 1, and 0.7;
n1=1 while n3 equals n2 and is chosen from 3, 2.5, and 1;
n1=0.7 while n3 equals n2 and is 3; or
n1=0.5 while n3 equals n2 and is 2.5.

ii)

A patch antenna wherein at least one patch is configured to operate in a broad frequency range which ranges from 2 GHz to 20 GHz, and wherein that patch is defined by the polar function:

$$\rho_d(\varphi) = \left(\left|\frac{1}{a}\cos\frac{m_1}{4}\varphi\right|^{n_2} + \left|\frac{1}{b}\sin\frac{m_2}{4}\varphi\right|^{n_3}\right)^{-\frac{1}{n_1}}$$

wherein:

m1=m2=1;
a=b=1;
n3 equals n2 and ranges from 1 to 10;
n1 ranges from 1 to 1.5.

iii)

A patch antenna wherein at least one patch is configured to operate in a broad frequency range which ranges from 2 GHz to 20 GHz, and wherein that patch is defined by the polar function:

$$\rho_d(\varphi) = \left(\left|\frac{1}{a}\cos\frac{m_1}{4}\varphi\right|^{n_2} + \left|\frac{1}{b}\sin\frac{m_2}{4}\varphi\right|^{n_3}\right)^{-\frac{1}{n_1}}$$

wherein:

m1 equals m2 and ranges from 3.6 to 4.5;
a=b=1;
n3=n2=3; and
n1=3.

iv)

A patch antenna wherein at least one patch is configured to operate in a broad frequency range which ranges from 2 GHz to 20 GHz, and wherein that patch is provided with a slot being an excised area within the patch, wherein the patch is defined by the polar function:

$$\rho_d(\varphi) = \left(\left|\frac{1}{a}\cos\frac{m_1}{4}\varphi\right|^{n_2} + \left|\frac{1}{b}\sin\frac{m_2}{4}\varphi\right|^{n_3}\right)^{-\frac{1}{n_1}}$$

wherein the above polar function ρd(φ) is multiplied by a scaling factor c1, and wherein m1=m2=2.25;
a=b=1;
n3=n2=3; and
n1=1.48.

wherein the slot within the patch is defined by the polar function:

$$\rho_d(\varphi) = \left(\left|\frac{1}{a}\cos\frac{m_1}{4}\varphi\right|^{n_2} + \left|\frac{1}{b}\sin\frac{m_2}{4}\varphi\right|^{n_3}\right)^{-\frac{1}{n_1}}$$

wherein the above polar function ρd(φ) is multiplied by a scaling factor c2, and wherein m1=m2=2.36;
a=b=1;
n3=n2=2.83; and
n1=1.43;
and wherein c1 is larger than c2 and c2 is at least 1, preferably c1 is at least two times larger than c2, more preferably c1=11.16 and c2=4.4

It has been found that an UWB patch antenna according to the above designs may further improve on the bandwidth achieved, when the feeding structure is a microstrip line, which is provided in parallel orientation to the perpendicular symmetry plane of the patch, at a distance from said symmetry plane, said distance being larger than the width of the microstrip line.

For instance, when using a microstrip line of 0.5 to 2.0 mm width, a distance from the symmetry plane between 2.0 and 5.0 mm, can result in an increase of bandwidth that can be 10 GHz or more, dependent on the specific base profile of the patch that is used.

v)

A patch antenna wherein at least one patch is configured to operate in a broad frequency range which ranges from 0.5 GHz to 4 GHz, and wherein that patch is defined by the polar function:

$$\rho_d(\varphi) = \left(\left|\frac{1}{a}\cos\frac{m_1}{4}\varphi\right|^{n_2} + \left|\frac{1}{b}\sin\frac{m_2}{4}\varphi\right|^{n_3}\right)^{-\frac{1}{n_1}}$$

wherein:

m1=m2=1;

a=b; and n3=n2.

The preferred embodiments of the invention also relate to an antenna system for transmitting and receiving electromagnetic signals comprising at least one patch antenna according to the invention. The antenna system comprises a plurality of MIMO-configured antennas (Multiple Input Multiple Output), wherein each antenna comprises multiple patches and multiple feed connectors, wherein at least two patches are connected to different feed connectors. The system preferably also comprises at least two multi-band antennas, and at least one processor for switching in at least one of the frequency bands, so ensuring diversity of reception and transmission of the signals in this band. Preferably, a processor is configured to control switching means, wherein the switching means is a SPDT (Single Port Double Throw) switch or a DPDT (Double Port Double Throw) switch. Preferably, the system further comprises at least one interface means for programming the at least one processor, and therefore for programming (configuring) the antenna as such.

According to some embodiments, the invention further relates to a method of manufacturing an antenna according to the invention, comprising:

A) designing at least one patch such that the patch has at least one base profile which is substantially supershaped, said supershape defined by the polar function:

$$\rho_d(\varphi) = \left(\left|\frac{1}{a}\cos\frac{m_1}{4}\varphi\right|^{n_2} + \left|\frac{1}{b}\sin\frac{m_2}{4}\varphi\right|^{n_3}\right)^{-\frac{1}{n_1}}$$

wherein:

$\rho d(\varphi)$ is a curve located in the XY-plane, $\varphi \in [0, 2\pi)$ is the angular coordinate, $m1 \neq 0$ and $m2 \neq 0$, and wherein at least one of n1, n2, and n3 does not equal 2, and preferably none of n1, n2, and n3 equals 2, B) assembling, by using a spacer structure, a ground plane, the at least one patch, and a feed connector which is insulated from the ground plane and which is conductively connected to at least one patch, wherein the patch and the ground plane are separated by the spacer structure.

According to some embodiments, advantages of using the superformula for designing the patch, and eventually the ground plane and intermediate spacer structure (substrate) have been described above already in a comprehensive manner. During step B) preferably multiple feed connectors are connected to different patches of the antenna, which more preferably, allows the antenna to communicate in a first frequency band and a distinctive second frequency band.

According to some embodiments, the invention further relates to a method for use in wireless communications by using an antenna according to the invention, the method comprising the step of connecting a communication circuit to an antenna network, the network comprising a plurality of antennas according to the invention, each antenna optimized for operation in at least one designated frequency band. The optimization of the antenna geometry and material completely depends on the specific purpose. The communication circuit commonly comprises a transmitter and/or a receiver which in combination form a transceiver. Each antenna is preferably optimized for operation in multiple frequency bands, wherein each probe is configured to operate within a designated (single) frequency or frequency band. The antennas can be connected either in parallel or in series.

According to some embodiments, the invention additionally relates to a patch as used in an antenna according to the invention. Advantages and embodiments of the patch have been described above in a comprehensive manner.

A still further embodiment of the present invention refers to an RF transceiver of a wireless communications device, wherein an antenna according to the invention is employed.

Finally, in some embodiments, the invention refers to an electronic device having a wireless interface which comprises an RF transceiver as described above.

BRIEF DESCRIPTION OF THE DRAWINGS

Various illustrative embodiments of the invention will be elucidated on the basis of non-limitative exemplary embodiments shown in the following figures. Herein:

FIG. 15A shows a three-dimensional view of another preferred embodiment of a patch antenna according to the invention, and FIG. 15B shows a microstrip feed connector in parallel orientation to the perpendicular symmetry of the plane of the patch of FIG. 15A, FIG. 16 shows a three-dimensional view of a prior art patch antenna.

DETAILED DISCUSSION OF THE PREFERRED EMBODIMENTS

Example Patch Antenna for GPR Applications

Ground Penetrating Radar (GPR) uses electromagnetic wide frequency band radar pulses to probe the earth subsurface. The transmitted radar pulses are reflected from various dielectric discontinuities within the ground and the reflected waves are detected from the receiving antenna. Soil horizons, the groundwater surface, soil/rock interfaces, man-made objects, or any other interface possessing a contrast in dielectric properties can be detected, localized and characterized with a high resolution. One of the most critical hardware components for the performance of the GPR system is the antenna. For impulse GPR, it is required that the antenna have sufficiently large bandwidth in order to transmit and receive short duration time domain waveforms with suppressed late-time ringing to avoid masking of targets. Additionally, the antenna must exhibit a linear phase characteristic over the whole operating frequency band for avoiding widening of the pulse over time. The operating frequencies and bandwidth of a GPR antenna are crucial for the system performance. GPR antennas must meet the broadband specifications, whereas higher frequencies are required for better resolution in order to determine small-size objects and lower frequencies are needed for depth penetration. So, the duration of the time domain antenna pulse is the trade off between range resolution and depth penetration. Moreover, high efficiency, high gain, portability, ease to use, small volume occupation for higher spatial sampling, easy mounting, integration capability with electronic circuits, ease of fabrication, etc. are basic requirements that GPR antennas must comply with. Resistively loaded cylindrical monopoles, resistively loaded bow-tie antennas, wire bow-tie antennas, TEM horns and their modification and spiral antennas have been widely used in the past in GPR systems. Although large antennas offer broadband behaviour, high resolution, deeper penetration and capability of compensation for ground's spectral filtering-effect, they are not compact and portable. Furthermore, most of, if not all, the present known patch GPR antennas (dipole, bow-tie, etc.) have rarely enough bandwidth to fully utilize GPR potentials and on the top of that they have no co-designed ground plane and they produce significant distortions when shielding or cavity is added.

Figure 1A:
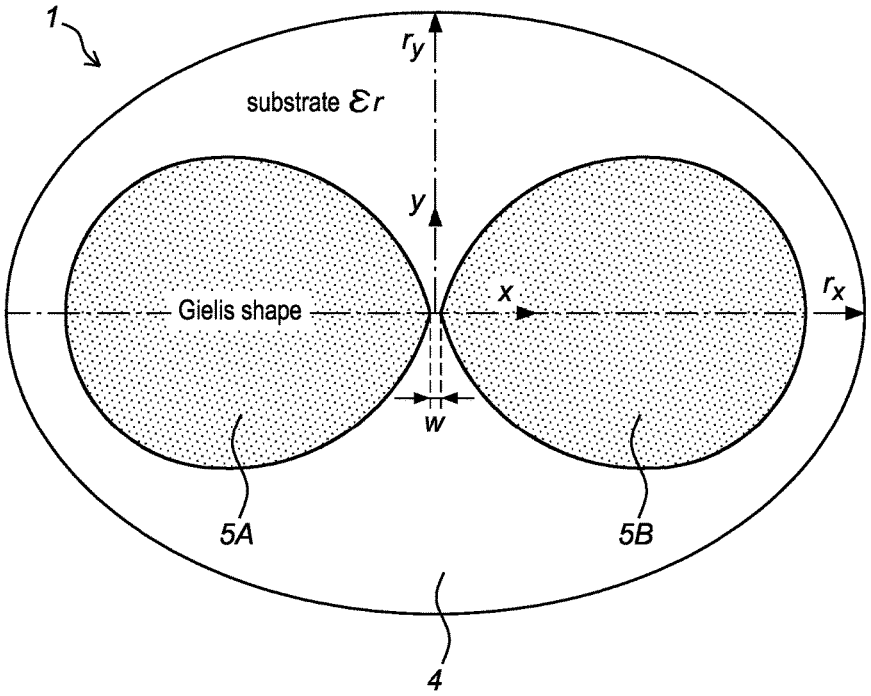
FIGS. 1*a* and 1*b* show a top view and a cross-section of a patch antenna according to the invention for advanced ground penetrating radar applications.
Figure 1B:
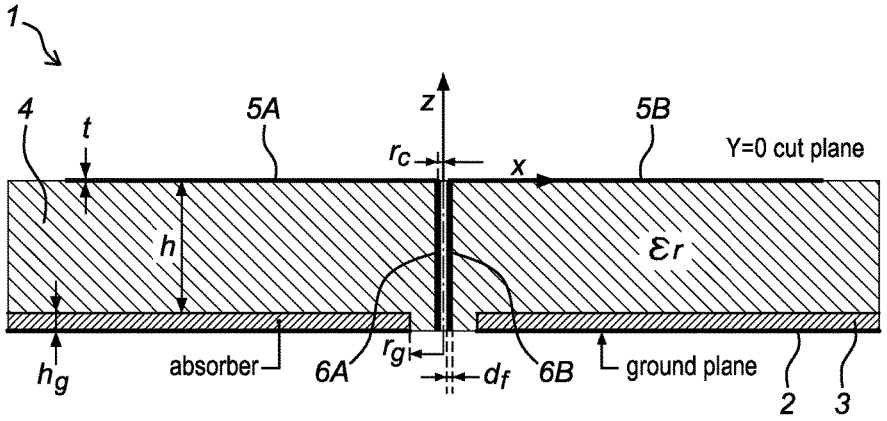

To overcome one or more of the above drawbacks, an improved patch antenna with a superb performance was designed, which is shown in FIGS. 1A and 1B, and which will be described in more detail below. The antenna featuring the proposed topology and architecture is capable of circumventing all the problems addressed above since it operates in the frequency band 0.5-4 GHz covering the low as well high frequency spectrum.

As shown in the top view of FIG. 1A and the cross-section of FIG. 1B, the patch antenna 1 comprises a laminate of a metal ground plane 2, an absorber layer 3, a dielectric substrate 4, and two metal patches 5*a*, 5*b* applied onto an (upper) surface of the substrate 4 directed away from the ground plane 2. Each of the patches 5*a*, 5*b* is connected to a feeding line 6*a*, 6*b* which is led through the substrate 4 and the absorber layer 3. A central hole provided in the ground plane 2 isolates the feeding lines 6*a*, 6*b* from the ground plane 2. The insertion of the thin absorber layer 3, made of absorbing material, between the ground plane 2 and the dielectric substrate 4 reduces the ringing effect of the transmitting pulse since it mitigates the wave reflections from the floating ground plane 2 without reducing significantly the efficiency of the antenna 1, as usually occurs in the case of restively loaded antenna designs. The absorber layer 3 is made of a magnetically loaded absorber ECCOSORB SF-1. Efficiency is an important factor on GPR systems since electromagnetic waves are propagating through the lossy soil.

The patches 5*a*, 5*b* have an identical shape and are symmetrically positioned supershaped wings, whose contour profile is determined by three continuous parameters of the supershape formula according to claim 1.

$$R_g(\varphi) = \left[\left|\frac{1}{\alpha}\cos\left(\frac{m}{4}\varphi\right)\right|^{n_2} + \left|\frac{1}{b}\sin\left(\frac{m}{4}\varphi\right)\right|^{n_3}\right]^{-1/n_1}$$

where $R_g(\varphi)$ is a curve located in the xy-plane and $\varphi \in [0; 2\pi)$ is the angular coordinate.

This equation is a polar function of the form $r=f(\varphi)$ and consists a generalization of the superellipse formula. The shape of the branches' profile can be controlled by tuning a set of six real and positive numerical parameters ($\alpha$; b; m; n1; n2; n3)$\in R^6$, with $\alpha$; $b \neq 0$. On consideration of low cross-polarization and limited edge diffraction, the following conditions are set: $\alpha=b$, m=1, and $n_2=n_3$. As a result, only three parameters ($\alpha$, $n_1$, $n_2$) are needed to form the optimized tear-drop shape as shown in FIG. 1A. The usage of the three parameters facilitates the optimization process aiming at the attainment of the desired impedance bandwidth characteristics. All the design parameter values are listed in Table I.

| Gielis parameters<br>(a, b, m, $n_1$, $n_2$, $n_3$) = (5.321, 5.321, 1, 0.458, 1.188, 1.188) | | |
|---|---|---|
| Solid geometry parameters [mm] | | |
| $r_x$ = 136.561 | $r_y$ = 94.707 | w = 2.225 |
| t = 0.017 | h = 42.48 | $h_g$ = 4.6 |
| $r_c$ = 1.895 | $d_f$ = 1.596 | $r_g$ = 10.805 |
| Substrate material parameters | | |
| $\varepsilon_r$ = 2.55 | tan $\delta_e$ = 0.0005 | tan $\delta_m$ = 0 |

The substrate 4 provides the antenna 1 structure rigidity, confinement of the field in the open-cavity, absorption of reflected waves and also allows reduction of the height of the structure. The substrate 4 is made of the dielectric material PREPERM with permittivity $\varepsilon_r$=2.55.

The feeding lines 6*a*, 6*b* are formed by two plated-through hole (PTH) pins with an input impedance of 100 Ohm through the circular slot in the ground plane 2. The practical PTH technique is introduced for reducing the reactance of the feed pins 6*a*, 6*b* and for bandwidth enhancement reasons as well.

Figure 2:
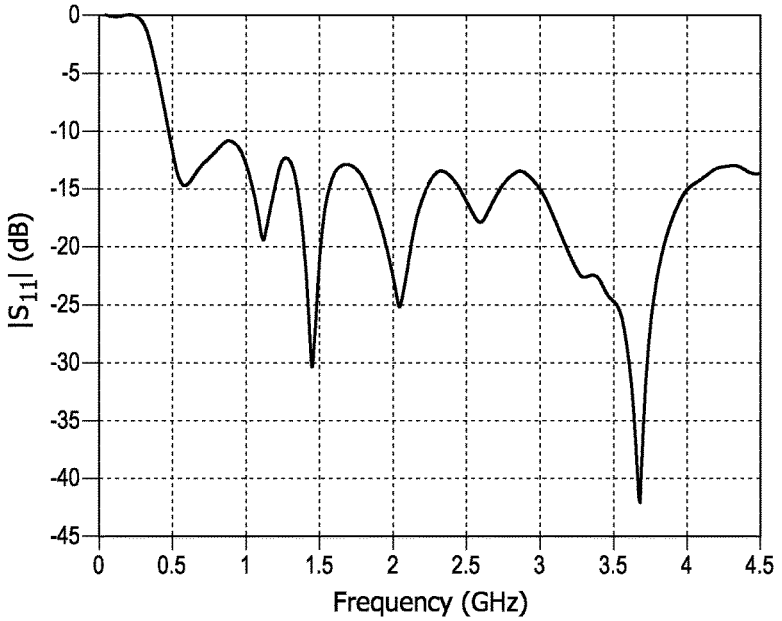
FIGS. 2-7 show various diagrams relating to the patch antenna according to FIGS. 1*a* and 1*b*.
Figure 3:
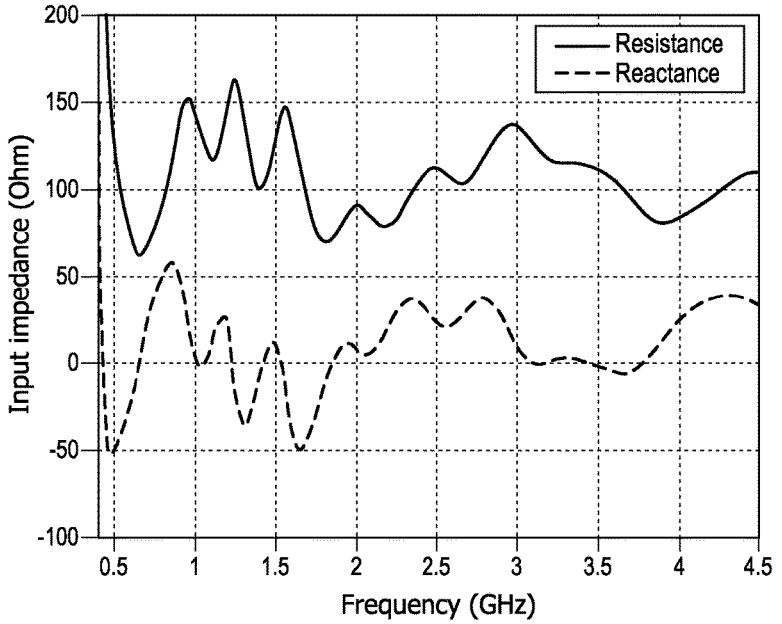

The return loss parameter of the supershaped dipole antenna 1 is presented in FIG. 2. It can be observed that the antenna 1 has a frequency impedance bandwidth ranging from 0.5 GHz to more than 4.5 GHz providing operation in low as well as high frequency spectrum. So, its pulse can penetrate into the ground and also provide high image resolution. It should be noticed that despite the antenna 1 occupies small volume due to its patch structure, it retains the full spectrum properties of an equivalent large antenna. The antenna 1 was designed to exhibit an input impedance of around 100 Ohm so that it is matched to the differential feeding line. The input impedance profile over the operating frequency range is presented in FIG. 3.

The time-domain antenna response consists of two parts, the main pulse and the ringing region. The main pulse results from the direct radiation of the excitation pulse at the feed point, while the ringing part is caused by reflections of the current pulse in the internal structure of the antenna 1 due to discontinuities and reflections from the ground plane. The primary goal for a transient antenna is the reduction of the pulse ringing region for avoiding masking of targets. The antenna shape plays an important role to the internal wave reflections since it determines the surface current distribution. The supershape formula provides the possibility of optimizing the antenna shape through the tuning of three parameters. In this way, the impedance discontinuities in the antenna structure that cause the unwanted reflections can be mitigated.

Figure 4A:
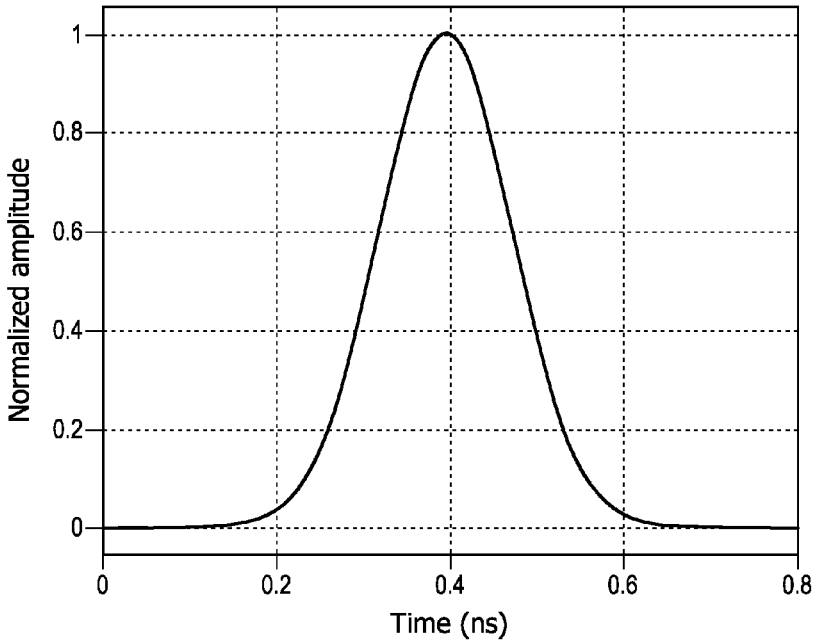
Figure 4B:
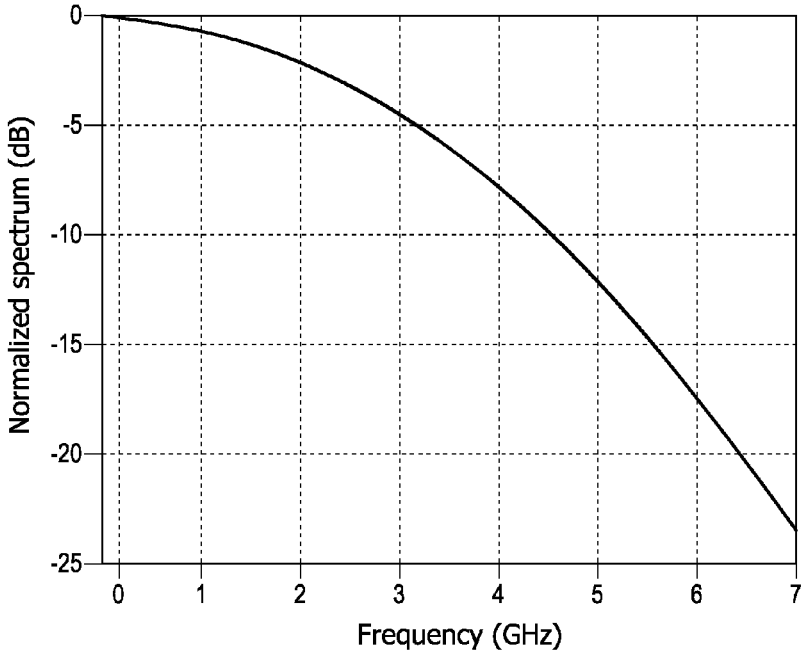
Figure 5:
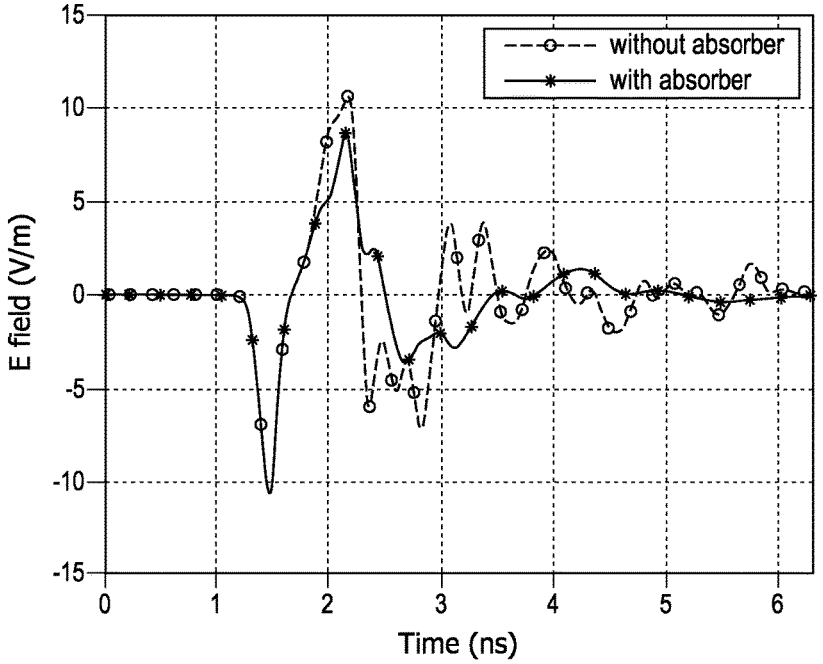
Figure 6:
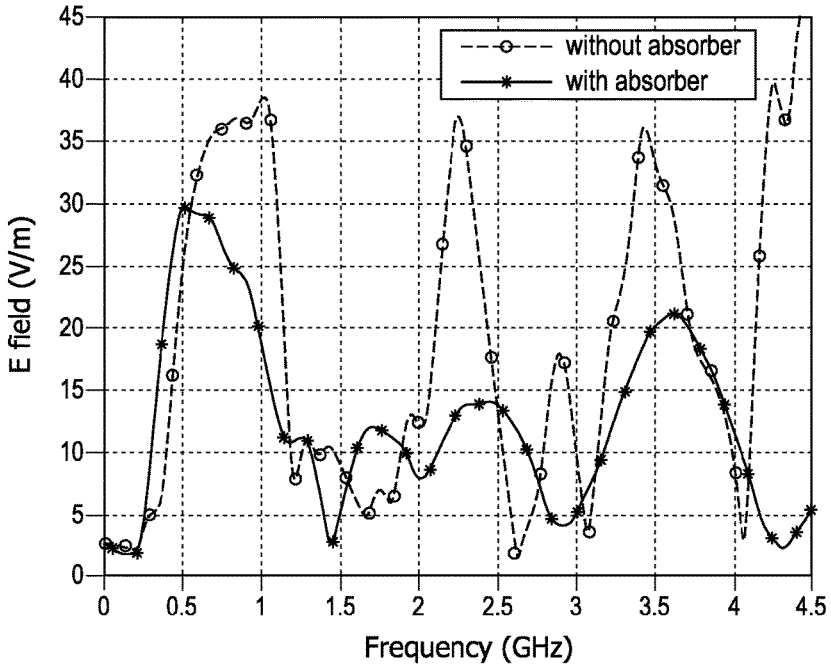

The excitation signal is a Gaussian pulse with duration about 0.6 ns. The waveform and the spectrum of the excitation pulse are presented in FIG. 4. Since antennas operate as electronic differentiators, it is expected that the output waveform is ideally the time derivative of the input signal. FIG. 5 shows the transmitted pulse in a distance of 25 cm in the broadside direction with and without the absorbing layer and FIG. 6 depicts the spectrum content of the transmitted pulse. In the case that there is no absorber, the intermediate structure would only consist of the substrate 4 only of the dielectric material PREPERM with thickness h=47.08 mm. It can be remarked that the ringing is significantly diminished while the pulse amplitude exhibits just a slight degradation due to the absorbing layer. Specifically, the peak-to-peak amplitude of the transmitting pulse is 21.11 V/m and 19.15 V/m for the supershaped antenna 1 without and with the resistive loading respectively. This means that the pulse amplitude reduction due to the introduction of the absorber is approximately a 9%.

Figure 7:
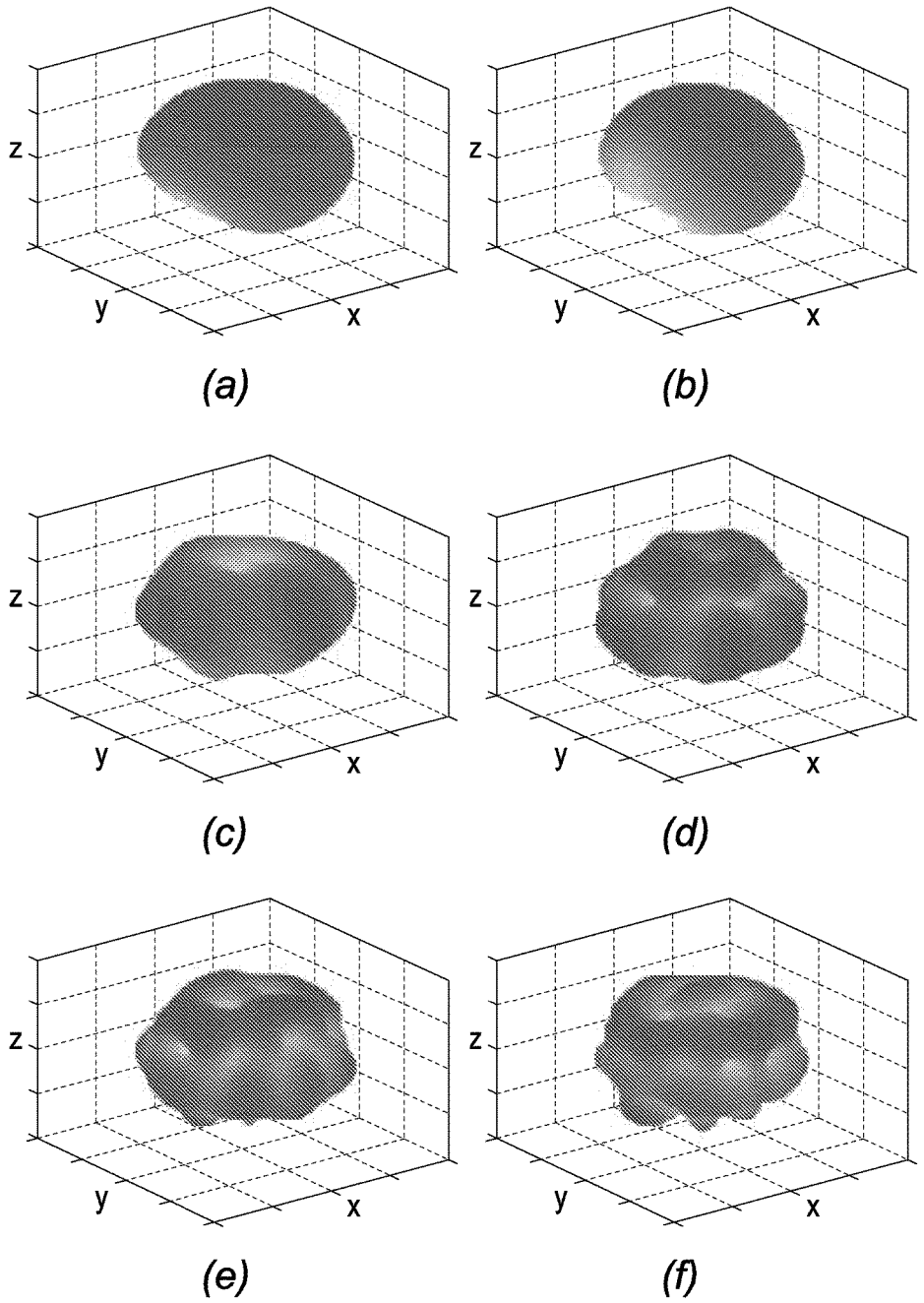

A fundamental requirement for a GPR antenna is to radiate towards the ground in order not to interfere with the electronic equipment of the GPR system. Also, the external signals influence from the upper half-space to the GPR receive antenna must be minimized. Therefore, for dipole-like antennas, which typically radiate omnidirectionally, shielding is needed. Shielding design can be a tricky process because it causes distortion to the time-domain pulse. The antenna 1 according to the invention, due to the floating ground plane provides electromagnetic isolation from the upper half-space without employing a shielding mechanism. In this way the manufacturing cost can be reduced drastically. The three dimensional free-space radiation patterns in four different frequencies from 0.5 GHz to 4 GHz are presented in FIG. 7. More in particular, the normalized radiation patterns of the supershaped dipole antenna 1 are shown at 0.5 GHz (FIG. 7A), 1 GHz (FIG. 7B), 2 GHz (FIG. 7C), 3 GHz (FIG. 7D), 3.5 GHz (FIG. 7E), and 4 GHz (FIG. 7F). As it can be observed, the antenna 1 radiates towards the broadside direction and the patterns are relatively stable over the operating frequency range. The stability and the limited compression and distortion of the radiation patterns is attributed to the shortened length of the antenna 1 (compared to a typical, known dipole) and the distribution of the current over the whole antenna area.

Hence, in FIGS. 1A and 1B and supported by FIGS. 2-7, a novel, compact antenna is shown with simple topology and unique architecture for GPR purposes. This antenna is the first bulbous-type GPR antenna that is mathematically designed with the supershape formula, leading to various advantages. It is capable of covering the frequency range 0.5-4 GHz, providing in this way depth penetration and range resolution capability at the same time. Via the insertion of the absorbing layer 3, the late-time ringing is reduced without affecting much the radiation efficiency of the antenna 1. Furthermore, the antenna 1, in contrast to known dipole-like designs, has no need for shielding or absorbing cavity because it features unidirectional radiation. This makes it a low-cost solution for GPR systems. Also it is simple to manufacture, portable and has outstanding performance in comparison with most of the traditional GPR antennas.

OTHER EXAMPLES

Figure 8:
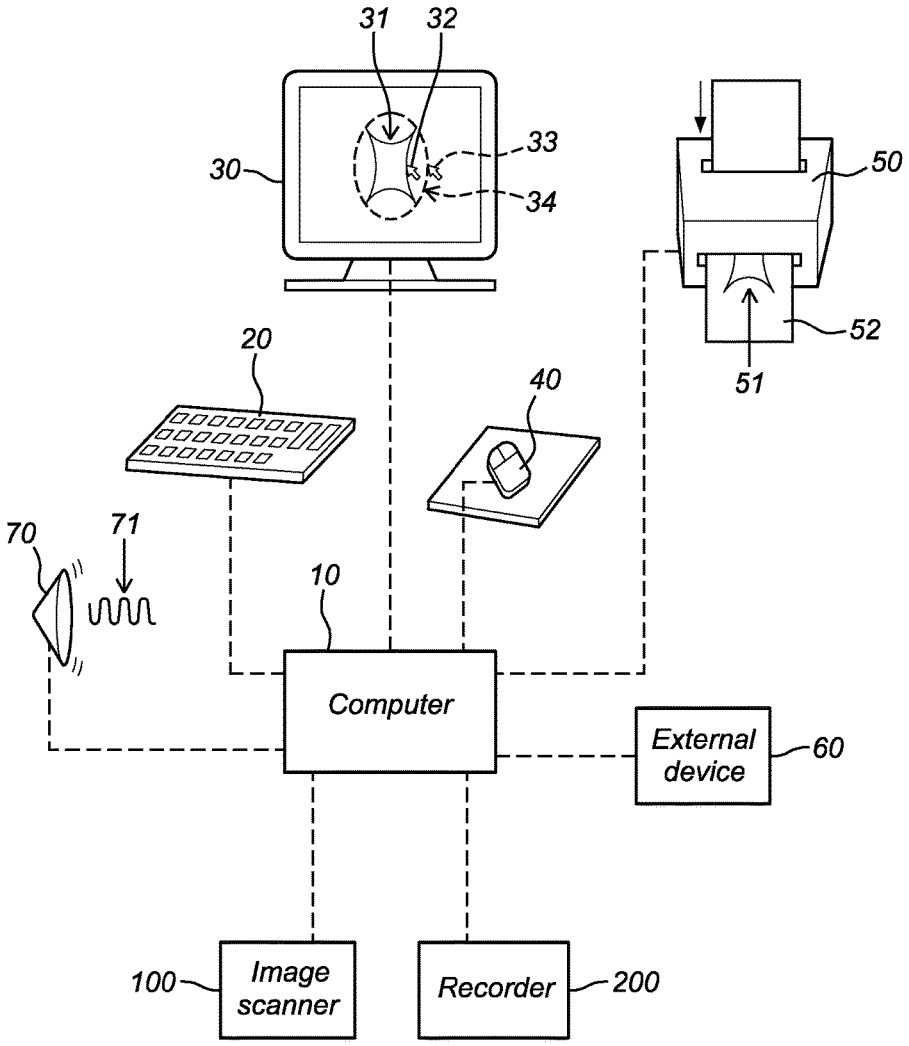
FIG. 8 shows a schematic diagram illustrating steps or phases that can be performed in exemplary embodiments involving synthesis of patterns with the super-formula.

Reference is made to FIG. 8, which is also incorporated in U.S. Pat. No. 7,620,527 as FIG. 16, shapes or waves of a ground plane and/or a patch of an antenna according to the invention, can be "synthesized" by the application of the following exemplary basic steps:

1) In a first step, a choice of parameters is made (e.g., by either inputting values into the computer 10, i.e., via a keyboard 20, a touch screen, a mouse-pointer, a voice recognition device or other input device or the like, or by having the computer 10 designate values), and the computer 10 is used to synthesize a selected super-shape based on the choice of parameters.
2) In a second optional step, the super-formula can be used to adapt the selected shapes, to calculate optimization, etc. This step can include use of: graphics programs (e.g., 2D, 3D, etc.); CAD software; finite element analysis programs; wave generation programs; or other software.
3) In a third step, the output from the first or second step is used to transform the computerized super-shapes into a physical form, such as via: (a) displaying the super-shapes 31 on a monitor 30, printing the super-shapes 51 upon stock material 52 such as paper from a printer 50 (2-D or 3-D); (b) performing computer aided manufacturing (e.g., by controlling an external device 60, such as machinery, robots, etc., based on the output of step three); (c) generating sound 71 via a speaker system 70 or the like; (d) performing stereo lithography; (e) performing rapid prototyping commonly based on 3D printing technology; and/or (f) utilizing the output in another manner known in the art for transforming such shapes.

Various computer aided manufacturing ("CAM") techniques and products made therefrom are known in the art and any appropriate CAM technique(s) and product(s) made can be selected. As just some examples of CAM techniques and products made therefrom, see the following U.S. Patents (titles in parentheses), the entire disclosures of which are incorporated herein by reference: U.S. Pat. No. 5,796,986 (Method and apparatus for linking computer aided design databases with numerical control machine database); U.S. Pat. No. 4,864,520 (Shape generating/creating system for computer aided design, computer aided manufacturing, computer aided engineering and computer applied technology); U.S. Pat. No. 5,587,912 (Computer aided processing of three dimensional objects and apparatus therefor); U.S. Pat. No. 5,880,962 (Computer aided processing of 3-D objects and apparatus thereof); U.S. Pat. No. 5,159,512 (Construction of Minkowski sums and derivatives morphological combinations of arbitrary polyhedral in CAD/CAM systems).

Various stereo lithography techniques and products made therefrom are known in the art and any appropriate stereo lithographic technique(s) and product(s) made can be selected. As just some examples of stereo lithographic techniques and products made therefrom, see the following U.S. Patents (titles in parentheses), the entire disclosures of which are incorporated herein by reference: U.S. Pat. No. 5,728,345 (Method for making an electrode for electrical discharge machining by use of a stereo lithography model); U.S. Pat. No. 5,711,911 (Method of and apparatus for making a three-dimensional object by stereo lithography); U.S. Pat. No. 5,639,413 (Methods and compositions related to stereo lithography); U.S. Pat. No. 5,616,293 (Rapid making of a prototype part or mold using stereo lithography model); U.S. Pat. No. 5,609,813 (Method of making a three-dimensional object by stereo lithography); U.S. Pat. No. 5,609,812 (Method of making a three-dimensional object by stereo lithography); U.S. Pat. No. 5,296,335

(Method for manufacturing fibre-reinforced parts utilizing stereo lithography tooling); U.S. Pat. No. 5,256,340 (Method of making a three-dimensional object by stereo lithography); U.S. Pat. No. 5,247,180 (Stereo lithographic apparatus and method of use); U.S. Pat. No. 5,236,637 (Method of and apparatus for production of three dimensional objects by stereo lithography); U.S. Pat. No. 5,217,653 (Method and apparatus for producing a stepless 3-dimensional object by stereo lithography); U.S. Pat. No. 5,184,307 (Method and apparatus for production of high resolution three-dimensional objects by stereo lithography); U.S. Pat. No. 5,182,715 (Rapid and accurate production of stereo lithographic parts); U.S. Pat. No. 5,182,056 (Stereo lithography method and apparatus employing various penetration depths); U.S. Pat. No. 5,182,055 (Method of making a three-dimensional object by stereo lithography); U.S. Pat. No. 5,167,882 (Stereo lithography method); U.S. Pat. No. 5,143,663 (Stereo lithography method and apparatus); U.S. Pat. No. 5,130,064 (Method of making a three dimensional object by stereo lithography); U.S. Pat. No. 5,059,021 (Apparatus and method for correcting for drift in production of objects by stereo lithography); U.S. Pat. No. 4,942,001 (Method of forming a three-dimensional object by stereo lithography and composition therefore); U.S. Pat. No. 4,844,144 (Investment casting utilizing patterns produced by stereo lithography).

Moreover, the present invention can be used in known micro-stereo lithographic procedures. For example, the present invention can, thus, be used in the creation of computer chips and other items. Some illustrative articles, the disclosures of which are incorporated herein by reference, are as follows: A. Bertsch, H Lorenz, P. Renaud "3D microfabrication by combining microstereolithography and thick resist UV lithography," Sensors and Actuators: A, 73, pp. 14-23, (1999). L. Beluze, A. Bertsch, P. Renaud "Microstereolithography: a new process to build complex 3D objects," Symposium on Design, Test and microfabrication of MEMs/MOEMs, Proceedings of SPIE, 3680(2), pp. 808-817, (1999). A. Bertsch, H. Lorenz, P. Renaud "Combining Microstereolithography and thick resist UV lithography for 3D microfabrication," Proceedings of the IEEE MEMS 98 Workshop, Heidelberg, Germany, pp. 18-23, (1998). A. Bertsch, J. Y. Jézéquel, J. C. André "Study of the spatial resolution of a new 3D microfabrication process: the microstereophotolithography using a dynamic mask-generator technique," Journal of Photochem. and Photobiol. A: Chemistry, 107, pp. 275-281, (1997). A. Bertsch, S. Zissi, J. Y. Jézéquel, S. Corbel, J. C. André "Microstereophotolithography using a liquid crystal display as dynamic mask-generator," Micro. Tech., 3(2), pp. 42-47, (1997). A. Bertsch, S. Zissi, M. Calin, S. Ballandras, A. Bourjault, D. Hauden, J. C. André "Conception and realization of miniaturized actuators fabricated by Microstereophotolithography and actuated by Shape Memory Alloys," Proceedings of the 3rd France-Japan Congress and 1st Europe-Asia Congress on Mechatronics, Besançon, 2, pp. 631-634, (1996).

Similarly, various rapid prototyping techniques and products made therefrom (e.g., moulds, etc.) are known in the art and any appropriate technique(s) and product(s) made can be selected. For example, three exemplary 3-Dimensional model rapid prototyping methods currently available, include, as described in U.S. Pat. No. 5,578,227, the disclosure of which is incorporated herein by reference: a) photocurable liquid solidification or stereo lithography (e.g., see above); b) selective laser sintering (SLS) or powder layer sintering; c) fused deposition modelling (FDM) or extruded molten plastic deposition method. As just some examples of rapid prototyping techniques and products made therefrom, see the following U.S. Patents (titles in parentheses), the entire disclosures of which are incorporated herein by reference: U.S. Pat. No. 5,846,370 (Rapid prototyping process and apparatus therefor); U.S. Pat. No. 5,818,718 (Higher order construction algorithm method for rapid prototyping); U.S. Pat. No. 5,796,620 (Computerized system for lost foam casting process using rapid tooling set-up); U.S. Pat. No. 5,663,883 (Rapid prototyping method); U.S. Pat. No. 5,622,577 (Rapid prototyping process and cooling chamber therefor); U.S. Pat. No. 5,587,913 (Method employing sequential two-dimensional geometry for producing shells for fabrication by a rapid prototyping system); U.S. Pat. No. 5,578,227 (Rapid prototyping system); U.S. Pat. No. 5,547,305 (Rapid, tool-less adjusting system for hot stick tooling); U.S. Pat. No. 5,491,643 (Method for optimizing parameters characteristic of an object developed in a rapid prototyping system); U.S. Pat. No. 5,458,825 (Utilization of blow molding tooling manufactured by stereo lithography for rapid container prototyping); U.S. Pat. No. 5,398,193 (Method of three-dimensional rapid prototyping through controlled layerwise deposition/extraction and apparatus therefor).

Figure 9:
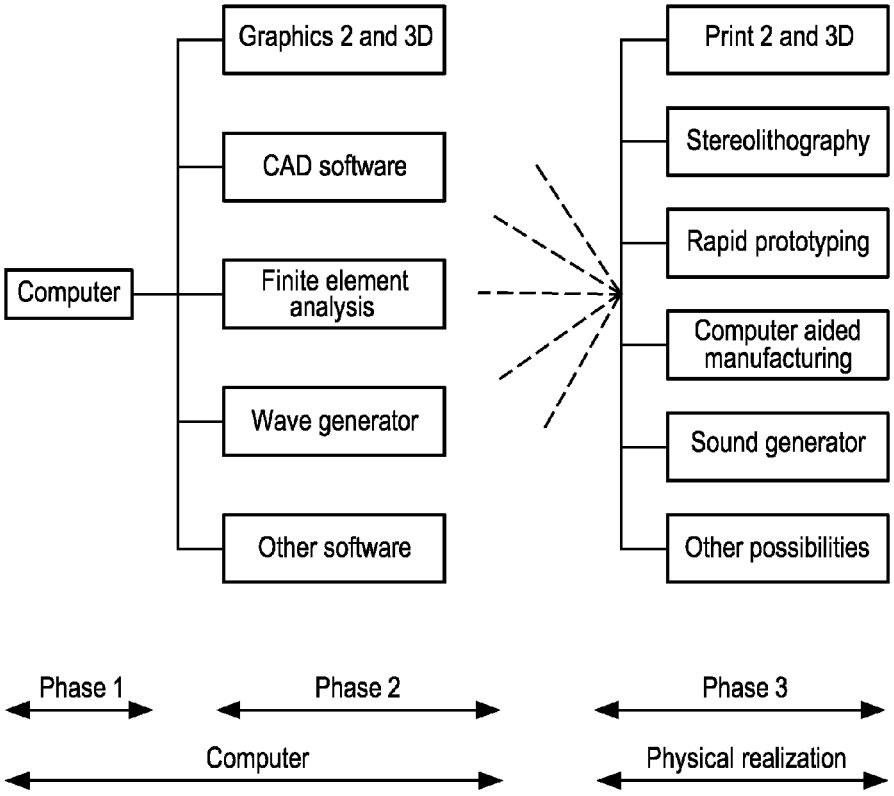
FIG. 9 shows a perspective view of an embodiment of a patch antenna according to the invention.

The above-noted three steps, or phases, are also schematically illustrated in the schematic diagram shown in FIG. 9 (steps 1 and 2 being capable of being carried out within the computer itself as shown). This figure corresponds to FIG. 17 of U.S. Pat. No. 7,620,527. In the following sections, a number of exemplary embodiments of pattern "synthesis" with the super-formula are described in further detail.

A. 2-D Graphical Software

The present invention has great utility in 2-D graphic software applications. The present invention can be applied, for example, in conventional commercial programs such as Corel-Draw™ and Corel-Paint™, Open Office applications, Supergraphx™ for Adobe Illustrator and Photoshop™, Adobe Photoshop™, in various drawing programs in Visual Basic™ or Windows™, or in other environments like, for example, Lotus WordPro™ and Lotus Freelance Graphics™, Java™, Visual C™, Visual C++™ and all other C-environments. The present invention has substantial advantages in image synthesis because, among other things, the present approach enables a substantial savings in computer memory space because only the super-formula with classical functions (such as powers, trigonometric functions, etc.) needs to be utilized. In addition, the number of image shapes available with the super-formula is substantially increased beyond that previously available. Graphics programs (such as Paint in Windows™, drawing tools in Microsoft Word™, Corel-Draw™, CAD, that used in architectural design, etc.) use "primitives" which are shapes programmed into the computer. These are very restrictive, e.g., often limited to mainly circles, ellipses, squares and rectangles (in 3-D, volumetric primitives are also very restricted). The introduction of the super-formula greatly enlarges by several orders of magnitude the overall possibilities in 2-D graphics (and also in 3-D graphics as discussed below). Used as a linear operator it can operate in many different ways and formulations, whether polar coordinates, etc., and also in 3-D using spherical coordinates, cylindrical coordinates, parametric formulations of homogenized cylinders, etc.

Some exemplary embodiments within 2-D graphics software applications are as follows.

a.1. The computer can be adapted to make plain use of the operator, in for example polar coordinates or in XY coordinates. In this sense, the parameters can be chosen (e.g., by an operator input or by the computer itself) and used as input in the super-formula (e.g., via programming). The individual shapes or objects can be used in any manner, such as to print or display an object, etc.

a.2. The computer can also be adapted to perform operations such as integration to calculate area, perimeter, moment of inertia, etc. In this regard, the computer can be adapted to perform such an operation either by a) selection of such operation via an operator input (e.g., via keyboard 20) orb) adapting of the computer (e.g., via pre-programming) to perform such operations.

a.3. The computer can be adapted (e.g., via software) to: a) display or otherwise present shapes; b) to allow a user to modify such shapes after the display thereof; and c) to display the shape as modified by the user. In this regard, the user can modify the shape by, for example, changing parameters. In an exemplary embodiment, the computer can be adapted to enable shapes that are displayed or otherwise presented (i.e., presented in step three noted above) by physically acting on the physical representation created in step three. In a preferred embodiment, the computer can be adapted to enable shapes that are displayed on a monitor to be modified by pulling out sides and/or corners of the pattern, e.g. image. In that regard, preferably, an image 31 is displayed on a computer screen or monitor 30 and a user can use his hand manipulated "mouse" 40 (or other user-manipulated screen or display pointer device) to place a displayed pointer 32 on the shape to "click" and "drag" the same to a new position 33-thereby moderating the super-shape to assume a new "super-shape" configuration 34. This will also include a recalculation of the formula and parameters.

a.4. The computer can also be adapted to perform Boolean operations whereby more than one of the individual shapes generated in a1 or a3 are taken together, either through the process of super-position. In some cases, individual super-shapes that are combined by, e.g., super-position and/or reiteration or the like may be, e.g., sectors or sections that are combinable to create shapes having differing sections or regions (as just one illustrative example, a sector of a circle between, e.g., 0 and $\pi/2$ can be combined with a sector of a square between, e.g., $\pi/2$ and $\pi$ to create a multi-component shape). The computer can also be adapted to perform additional operations upon the created super-shapes—e.g., to flatten, skew, elongated, enlarge, rotate, move or translate, or otherwise modify such shapes.

B. 3-D Graphical Software

As with 2-D applications, the present invention has great utility in 3-D graphic software applications (as well as in representations in various other dimensions).

The present invention can be applied, for example, in Computer Aided Design ("CAD") software, software for Finite Element Analysis ("FEM"), Supergraphx 3D Shape Explorer, antenna design and analysis software, such as CST, Ansoft HFSS, Remcom XFdtd, EMSS Feko, Empire XCcel, architectural design software, etc. The present invention allows, for example, one to use single continuous functions, rather than spline functions, for various applications. Industrial applications of CAD include, e.g., use in Rapid Prototyping or in Computer Aided Manufacturing ("CAM") including 3D printing.

Figure 10A:
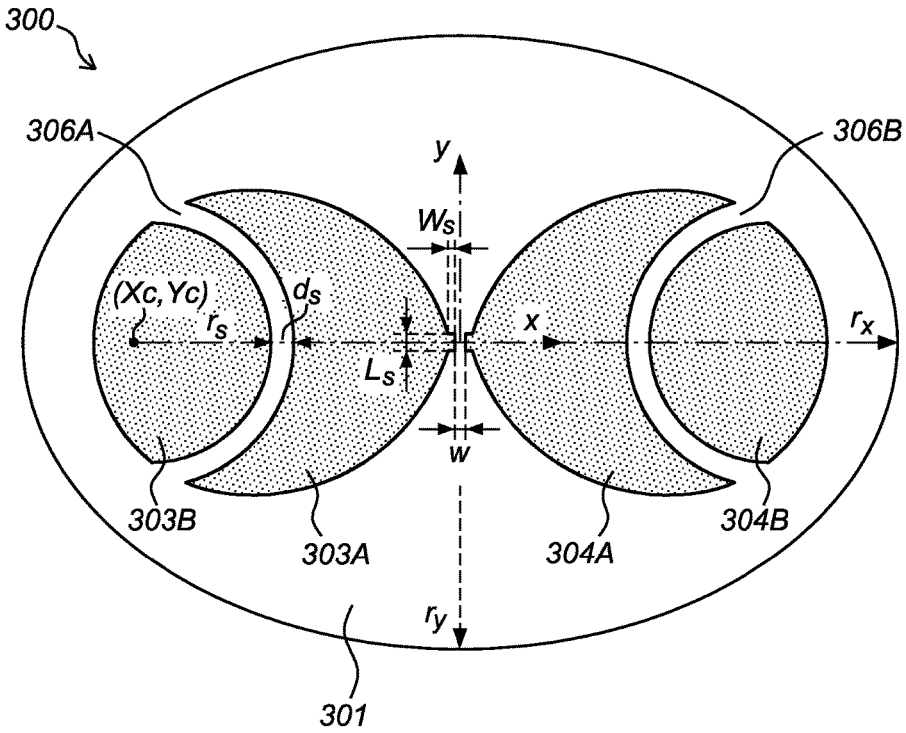
FIGS. 10A and 10B show a top view and a cross-section of another patch antenna according to the invention.
Figure 10B:
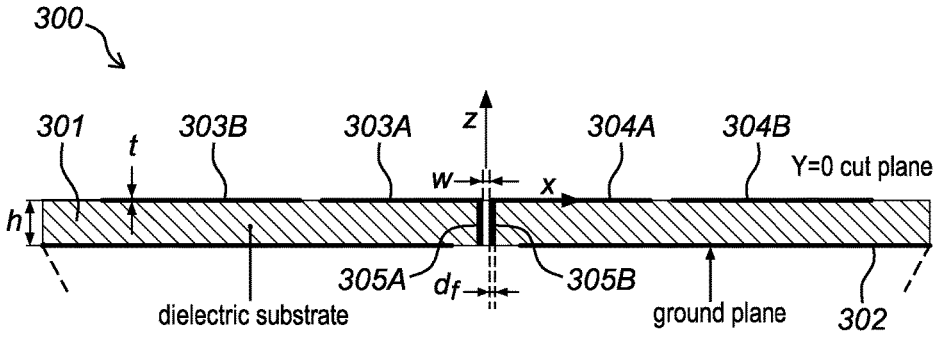

Reference is made to FIGS. 10A and 10B, wherein an embodiment of a patch antenna 300 according to preferred embodiments of the invention is shown. The antenna 300 comprises as substrate 301 acting as carrier structure spacing a electrically conductive ground plane 302 on one side and multiple conductive patches 303*a*, 303*b*, 304*a*, 304*b* deposited onto an opposite side of the substrate 301. The patches 303*a*, 303*b*, 304*a*, 304*b* are arranged in two patch sets, wherein each patch set is formed by a primary patch 303*a*, 304*a* and a secondary patch 303*b*, 304*b* positioned at close distance to the primary patch 303*a*, 304*a*, such that electromagnetic interaction between the primary patch 303*a*, 304*a* and the secondary patch 304*b*, 304*b* can occur during operation. Each primary patch 303*a*, 304*a* is connected to a feed connector 305*a*, 305*b*, also referred to a feeding lines, feeding structures, of feeding probes, which are led through the substrate 301 and through a central hole provided in the ground plane 302. The secondary patches 303*b*, 304*b* are not directly connected to a feed connector. Since each of the primary patches 303*a*, 304*a* is connected to a feed connector 305*a*, 305*b*, these primary patches 303*a*, 304*a* become primarily activated. Activation of the primary patches 303*a*, 304*a* will lead to subsequent activation (resonance) of the secondary patches 303*b*, 304*b*. The base profile of each patch set (303*a*, 303*b*; 304*a*, 304*b*) complies substantially with a base profile defined by the polar function:

$$\rho_d(\varphi) = \left(\left|\frac{1}{a}\cos\left(\frac{m}{4}\varphi\right)\right|^{n_2} + \left|\frac{1}{b}\sin\left(\frac{m}{4}\varphi\right)\right|^{n_3}\right)^{-1/n_1}$$

wherein $\rho_d(\varphi)$ is a curve located in the xy-plane and $\varphi \epsilon [0, 2\pi)$ is the angular coordinate. In this example the following values are used to arrive at the shape of the (cross-section of the) patch 302 as shown in FIGS. 10A and 10B: a=b=5.74; m=1; and $n_1$=0.4825, and $n_2$=$n_3$=1.0662. The thickness of the patches 303*a*, 303*b*; 304*a*, 304*b* is typically about a few micrometer. In this example the patch thickness t equals to 0.068 mm. The distance w between the feed connectors 305*a*, 305*b* equals to 5.253 mm in this example. The diameter or thickness $d_f$ of each feed connector 305*a*, 305*b* equals to 1.82 in this example.

Figure 11:
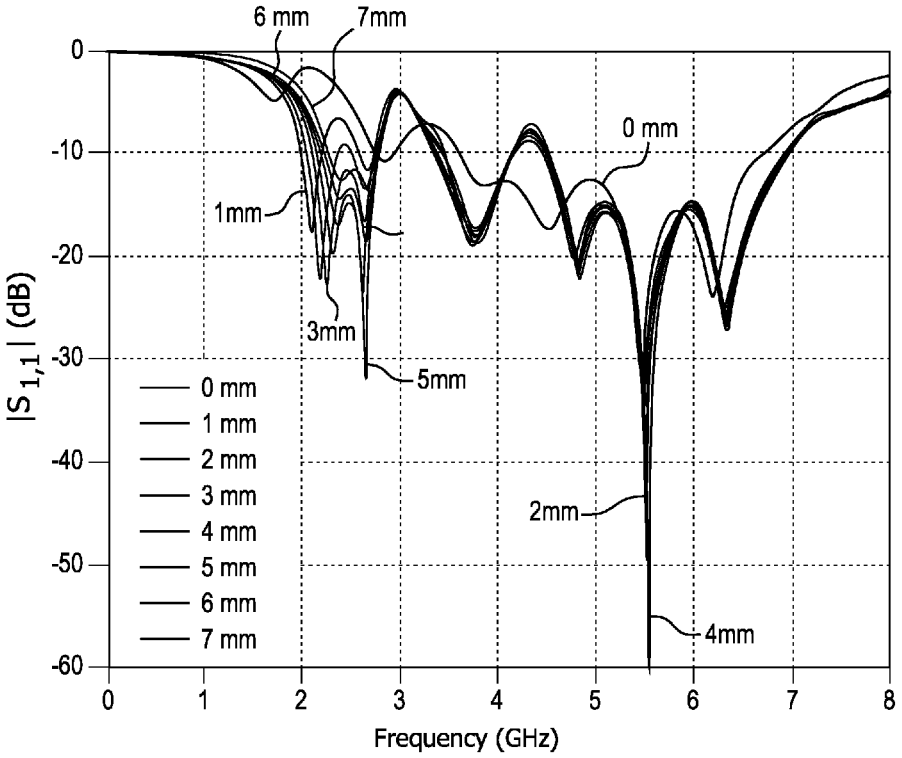
FIG. 11-12 show different diagram related to the patch antenna according to FIGS. 10A-10B, FIGS. 13A-13B show different view of another patch antenna according to the invention.
Figure 12:
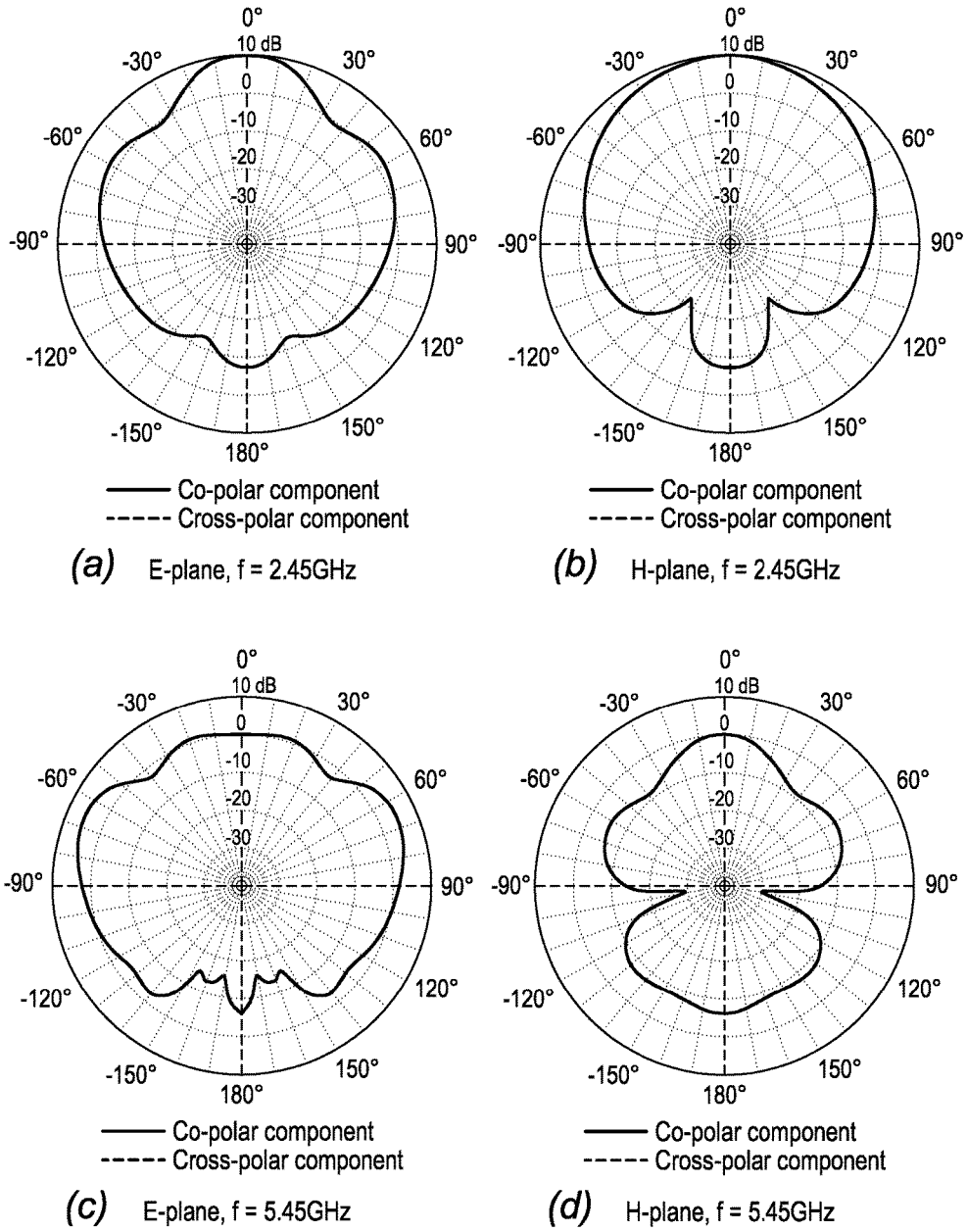

The antenna 300 as shown in FIGS. 10A and 10B is configured as omnidirectional Wi-Fi dual-band antenna 300 and is configured to operate both at a first frequency band of 2.2-2.77 GHz (802.11b/g/n) and at a second frequency band of 4.53-6.96 GHz (802.11a/n/ac). Both frequency bands can be controlled independently. The secondary patches 303*b*, 304*b* play an important role for allowing the antenna 300 to operate in the lower frequency band. The same applies to a gap 306*a*, 306*b* positioned in between each primary patch 303*a*, 304*a* and each secondary patch 303*b*, 304*b*. The geometry of the gap 306*a*, 306*b* (or slot) also substantially complies with at least a part of a supershaped base profile defined by the above polar function. By means of R-functions both the supershaped patch set and the supershaped gap 306*a*, 306*b* can be combined to an assembly of supershaped geometries. In this example, each gap has 306*a*, 306*b* has the shape of a segment of a circle. Experiments have shown that the frequency response is dependent on the gap width, which is shown in FIG. 11. In this example, an optimum gap width, wherein the antenna 300 operates very well in both frequency bands is 5 millimeter. Other gap widths (larger or smaller) will lead to a poorer antenna performance. In this example, the x-radius of the substrate 301 and the ground plane 302 equals to 8.64 cm and the y-radius equals to 5.92 cm. The thickness of the substrate 301 equals to 9.525 mm in this example, which is substantially equal to ⅛ wavelength in the low band. The radiation patterns of the antenna 300, both in the E-plane and in the H-plane, are shown in FIG. 12, both at a frequency of 2.45 GHz and at a frequency of 5.45 GHz. As can be seen the radiation patterns are omnidirectional. A back cavity can therefore be omitted. The radiation efficiency is very high and is between 98.5% and 99.1%. Between the two symmetry planes no cross polarization occurs. Hence, an outstanding antenna performance is achieved by using the antenna as shown in FIGS. 10A and 10B.

Figure 13A:
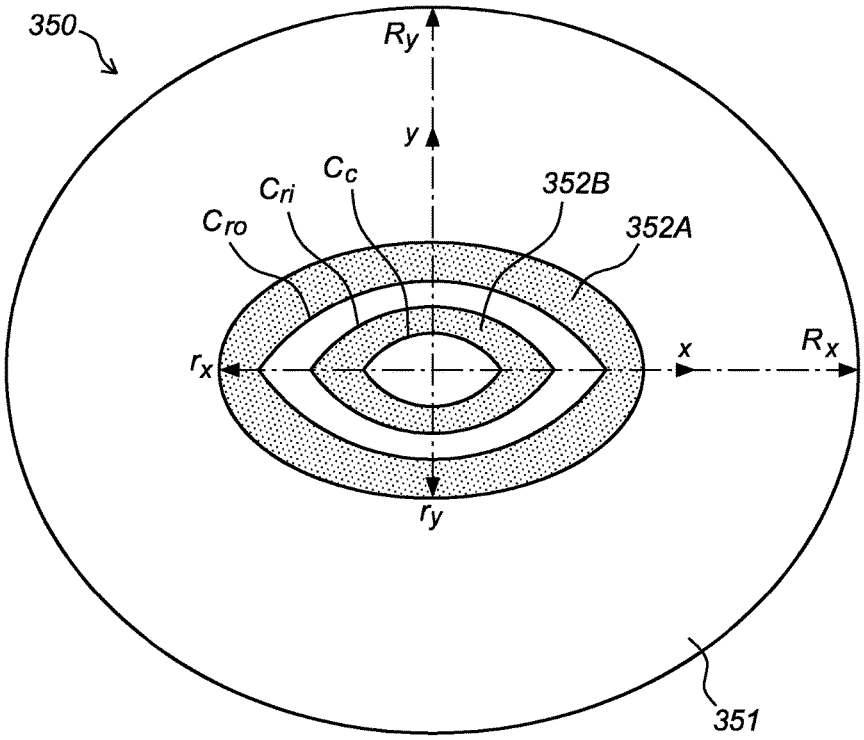
Figure 13B:
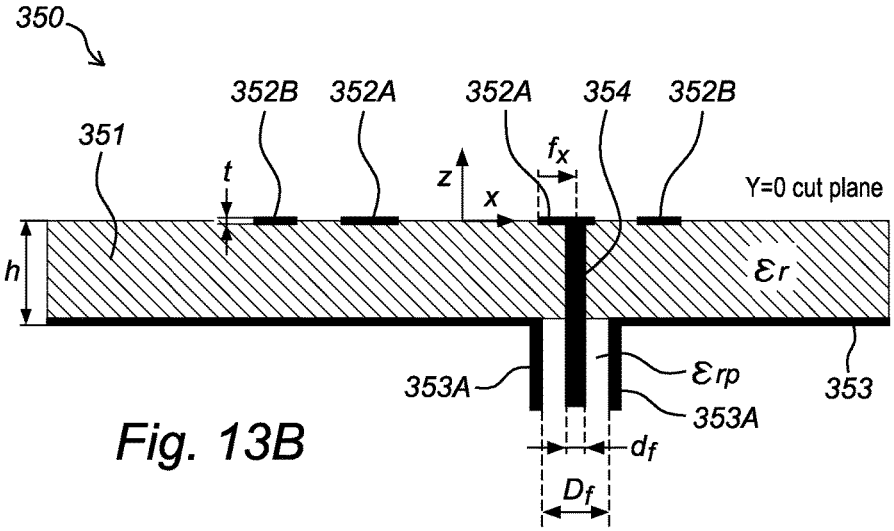

An alternative patch antenna 350 according to the invention is shown in FIG. 13A (top view) and in FIG. 13B (cross-section). The antenna 350 comprises a dielectric substrate 351 forming the core of the antenna 350. A top surface of the substrate 351 is provided with two metal patches 352*a*, 352*b*, in particular an inner patch 352*a* (primary patch) and an outer patch 352*b* (secondary patch) enclosing the inner patch 253*a*. A bottom surface of the substrate 351 is provided with a metal ground plane 353. The ground plane 353 is provided with a tubular shaped central part 353*a* enclosing a pass-through opening for a metal feed connector 354 connected to the inner patch 253*a*. To this end, the feed connector 354 extends through the dielectric substrate 351. The patches 352*a*, 352*b* and the feed connector 354 on one side and the ground plane 353 on the other side are mutually separated (insulated). The assembly of patches 352*a*, 352*b*, and in particular the geometry of this assembly is based upon a superposition of supershape based base profile as defined by the polar function according to claim 1. More in particular, the assembly as shown is composed of four superposed layers, wherein successively a first layer is formed by an elliptical solid (filled with material) outer shape, a second layer is formed by a supershaped, in particular mouth shaped, blank (free of material) layer, a third layer is formed by a smaller supershaped, in particular mouth shaped, solid layer, and a superposed top layer (fourth layer) is formed by a smaller supershaped, in particular mouth shaped, blank layer. This superposition of layers results in the situation, as shown, that the primary patch 352*a* is substantially mouth shaped, both at an inner edge $C_{Ii}$ and an outer edge $C_{Io}$, which primary patch 352A is enclosed by the secondary patch 352*b*, wherein an inner edge $C_{2i}$ of the secondary patch 352*b* is substantially mouth shaped, and an outer edge of the secondary patch 352*b* is elliptically shaped. By means of a computing device, said superposition of supershaped layers can easily be done by using R-functions. The following parameters are used in the polar equations leading to base profiles, the edges of which corresponds to $C_{Ii}$, $C_{Io}$, and $C_{2i}$ respectively.

| | α | b | m | $n_1$ | $n_2$ | $n_3$ |
|---|---|---|---|---|---|---|
| $C_{1i}$ | 2.618 | 2.618 | 2 | 0.5 | 1 | 1 |
| $C_{1o}$ | 3.418 | 3.418 | 2 | 0.5 | 1 | 1 |
| $C_{2i}$ | 4.05 | 4.05 | 2 | 0.5 | 1 | 1 |

According to experimental testing, the above values has led to optimum design of the patches 352*a*, 352*b* and of a gap 355 situated in between said patches 352*a*, 352*b* in order to gain the best performance of the antenna 350 as Wi-Fi dual-band antenna in the 2.4 GHz (2.35-2.52 GHz) and the 5 GHz (5.12-5.94 GHz) frequency band. The dielectric substrate 351 and the ground plane 353 have an identical elliptical design and dimensioning. The length $R_x$ of the substrate 351 and ground plane 353 equals to 39.7 mm in this example, while the width $R_y$ equals to 33.7 mm. The outer dimensioning of the secondary patch 352*b* in this example is that the length $r_x$ equals to 19.8 mm, while the width $r_y$ equals to 11.8 mm. The thickness h of the substrate 351 equals to 9.525 mm in this example. The patch thickness t equals to 0.07 mm. The thickness $d_f$ of the feed connector 354 equals to 1.28 mm. The inner diameter $D_f$ of the tubular portion 353*a* of the ground plane 353 equals to 4.28 mm. This leads to a distance of 1.5 mm between the feed connector 354 and the ground plane 353.

Figure 14:
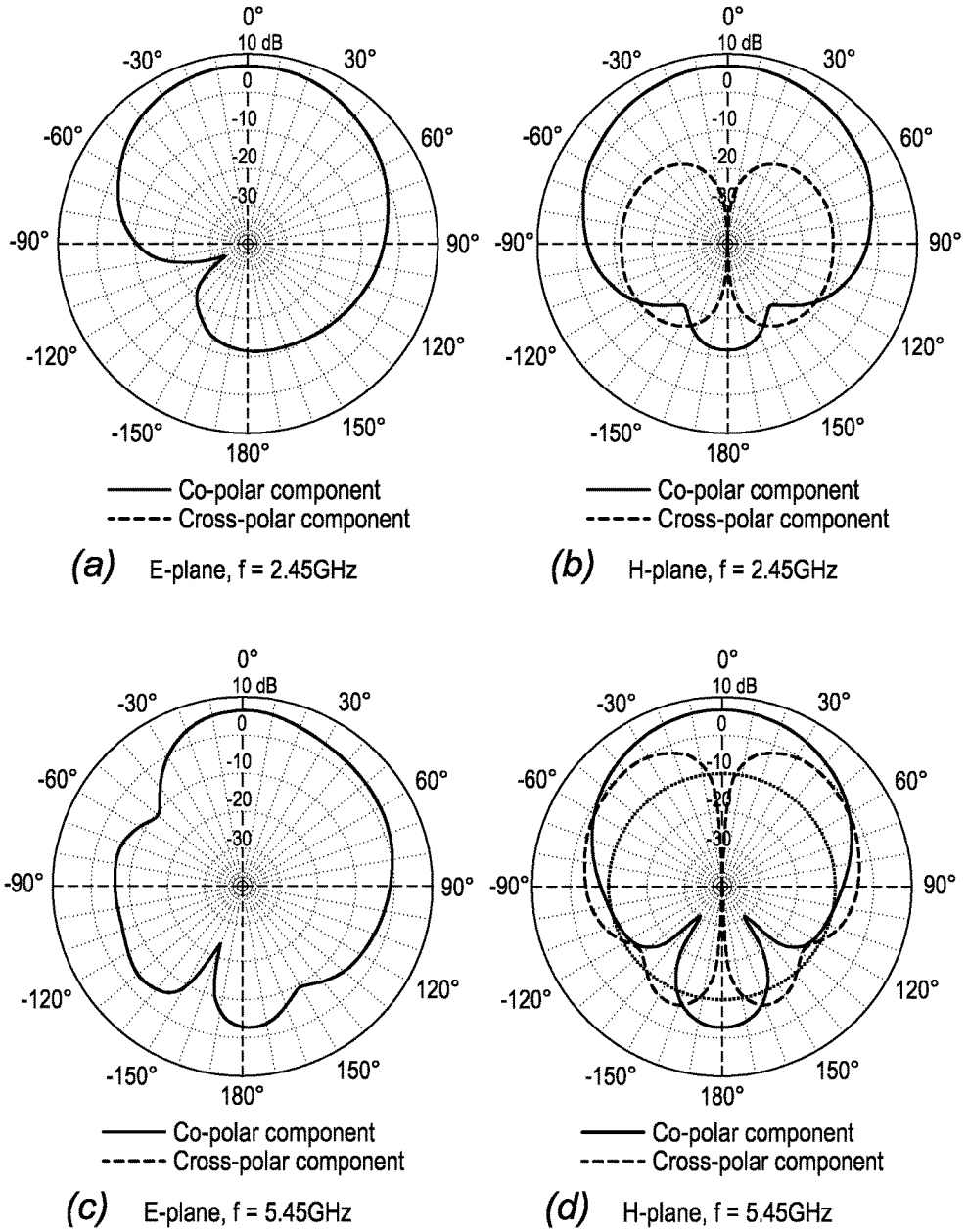
FIG. 14 shows a diagram related to the patch antenna as shown in FIGS. 13A-13B.

As shown in FIG. 14, the realized radiation patterns are unidirectional. The radiation efficiency is relatively high and varies from 94.4% to 98.8%. The realized gain also shows outstanding results, and is situated between 6.84 dB and 7.08 dB.

FIG. 15A shows a three-dimensional view of another preferred embodiment of the invention, i.e. a patch antenna 400, comprising a patch 402, a feed connector 404 and a substrate 406. The backside of the substrate is covered by a ground plane (not visible in the Figure) the surface of which is of the same size as the ground plane. The thickness of the ground plane and the patch 402 is considerably smaller in comparison to the ground plane. The substrate 406 is made out of dielectric material and acts as a spacer structure between the ground plane and the patch 402. The feed connector 404 has the form of a microstrip that is led over the surface of the substrate 406. The base profile of the patch 402 complies substantially with a base profile defined by the polar function:

$$\rho_d(\varphi) = \frac{1}{\sqrt[n_1]{\left|\frac{1}{a}\cos\frac{m_1}{4}\varphi\right|^{n_2} + \left|\frac{1}{b}\sin\frac{m_2}{4}\varphi\right|^{n_3}}}$$

$$a, b \in \mathbb{R}^+;\ m_1, m_2, n_1, n_2, n_3 \in \mathbb{R},\ a, b, n_1 \neq 0$$

wherein ρd(φ) is a curve located in the xy-plane and φ∈[0, 2π) is the angular coordinate. In this example the following values are used to arrive at the shape of the patch 406 as shown: $m_1$=4, $m_2$=4, a=1, =b=1, $n_1$=2, $n_2$=6 and $n_3$=6.

The patch antenna 400 shown in FIG. 15A is configured as a single band antenna which is configured to operate at a frequency band of 10.2 GHz. The total efficiency of the antenna at 10.2 GHz is approximately 82%. The maximum directivity is 13.2 dBi (in comparison: a short dipole antenna achieves 1.76 dBi, a large dish antenna achieves 50 dBi).

FIG. 15B shows an embodiment similar to that of FIG. 15A, with a feed connector in the form of a microstrip 404B in parallel orientation to the perpendicular symmetry of the plane 408 of the patch of FIG. 15A.

COMPARATIVE EXAMPLE

FIG. 16 shows a three-dimensional view of a known design of a patch antenna 450 according to the prior art, comprising a circular patch 452, a feed connector 454 and a substrate 456. The backside of the substrate is covered by a ground plane (not visible in the Figure) the surface of which is of the same size as the ground plane. The thickness of the ground plane and the patch 452 is considerably smaller in comparison to the ground plane.

The substrate 456 is made out of dielectric material and acts as a spacer structure between the ground plane and the patch 452. The feed connector 454 has the form of a microstrip that is led over the surface of the substrate 456. The base profile of the circular patch 452 does not comply with a base profile according to the invention, as this requires for the polar function that defines the base profile, that $m_1$=0 and $m_2$=0. The patch antenna 450 shown in FIG. 15 is configured as a single band antenna which is configured to operate at a frequency band of 11.12 GHz. The total efficiency of the antenna at 11.12 GHz is approximately 4.2%. The maximum directivity at 11.12 GHz is 5.6 dBi.

This comparative example demonstrates that both the total efficiency and the maximum directivity of a known patch antenna can be raised significantly, by re-designing the base profile of the patch in such a way that it is substantially defined by the superformula as referred to in claim 1.

Figure 17:
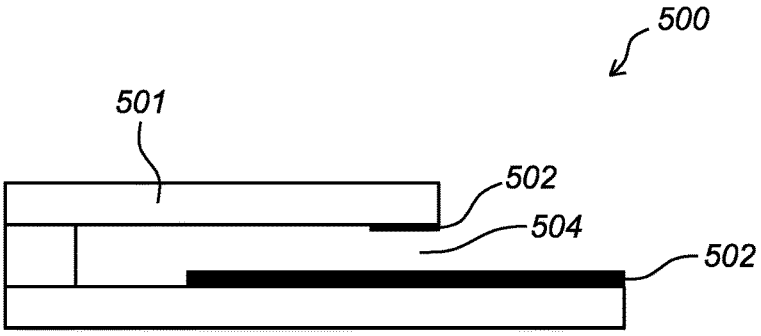
FIG. 17 shows a cross-section of an alternative patch antenna according to the invention.

FIG. 17 shows a cross-section of an alternative patch antenna 500 according to the invention. The patch antenna 500 comprises a dielectric U-shaped spacer structure 501 acting a mounting structure both for supporting an electrically conductive ground plane 502 and for carrying at least one electrically conductive patch 503. A dielectric air gap 504 is present in between the ground plane 502 and the at least one patch 503. At least one patch is connected to a feed connector (not shown). Both a feed connector and the ground plane 502 are connected to a power source (not shown) for powering the antenna 500. A base profile of the patch 503 and eventually the ground plane 502 are designed and defined by the polar function:

$$\rho_d(\varphi) = \left(\left|\frac{1}{a}\cos\frac{m_1}{4}\varphi\right|^{n_2} + \left|\frac{1}{b}\sin\frac{m_2}{4}\varphi\right|^{n_3}\right)^{-\frac{1}{n_1}}$$

wherein:

ρd(φ) is a curve located in the XY-plane,

φ∈[0, 2π) is the angular coordinate, preferably m1≠0 and m2≠0, and preferably n1=n2=n3≠2.

As elucidated above, application of at least one supershaped patch leads to a significant improvement of the antenna performance.

Examples of Ultra Wide Band Antennas

The supershaped patch antenna according to the present invention can also be used for designing an ultra-wide band antenna (UWB) for which it is required that the antenna is operable over a frequency range from 2 to 20 GHz, while achieving a scattering parameter S11 with magnitude around or below −10 dB over substantially the whole frequency range.

The FCC and the International Telecommunication Union Radio communication Sector currently define UWB in terms of a transmission from an antenna for which the emitted signal bandwidth exceeds the lesser of 500 MHz or 20% of the center frequency.

Circular-Like Supershapes

The patch antenna has the following basic built-up:

an electrically conductive patch, an electrically conductive ground plane which is rectangular, at least one feed connector in the form of microstrip feeding of 50 Ohm impedance which is insulated from the ground plane and which is conductively connected to at least one patch, and at least one dielectric substrate for separating the at least one patch and the at least one ground plane, wherein at least one patch is defined by at least a part of at least one base profile which is substantially supershaped, wherein said supershaped base profile is defined by the polar function:

$$\rho_d(\varphi) = \left(\left|\frac{1}{a}\cos\frac{m_1}{4}\varphi\right|^{n_2} + \left|\frac{1}{b}\sin\frac{m_2}{4}\varphi\right|^{n_3}\right)^{-\frac{1}{n_1}}$$

wherein:

ρd(φ) is a curve located in the XY-plane,

φ∈[0, 2π) is the angular coordinate.

A commercially available 'Rogers RO4003C' substrate having a relative dielectric constant ∃$_r$=3.55, losses 6=0.027 and thickness h=0.46 mm is preferably used.

In addition, the supershaped patch fulfills the following conditions:

m1 equals m2 and ranges from 1 to 3.5;

a=b=1;

n3 equals n2 and ranges from 0.7 to 3; and n1 ranges from 0.5 to 3, and more specifically:

m1 equals m2 and ranges from 1 to 3.5;

a=b=1;

combined with either:

n1=3 while n3 equals n2 and is chosen from 3, 1, and 0.7;

n1=1 while n3 equals n2 and is chosen from 3, 2.5, and 1;

n1=0.7 while n3 equals n2 and is 3; or n1=0.5 while n3 equals n2 and is 2.5.

Figure 18A:
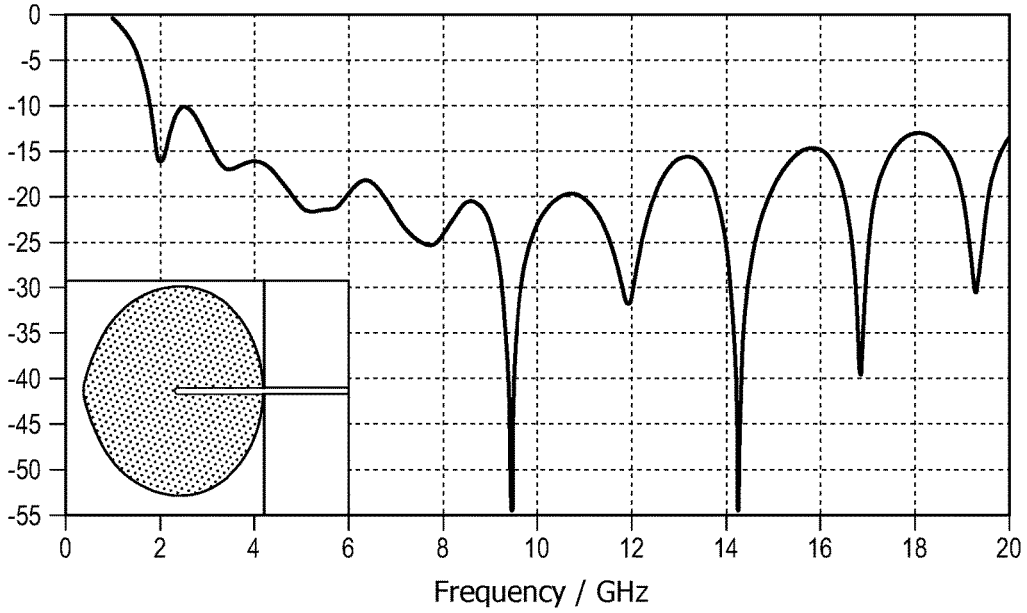
FIGS. 18-22 show some results and the patch supershape of preferred patch antennas according to the invention that are suitable for ultra wide band applications.
Figure 18B:
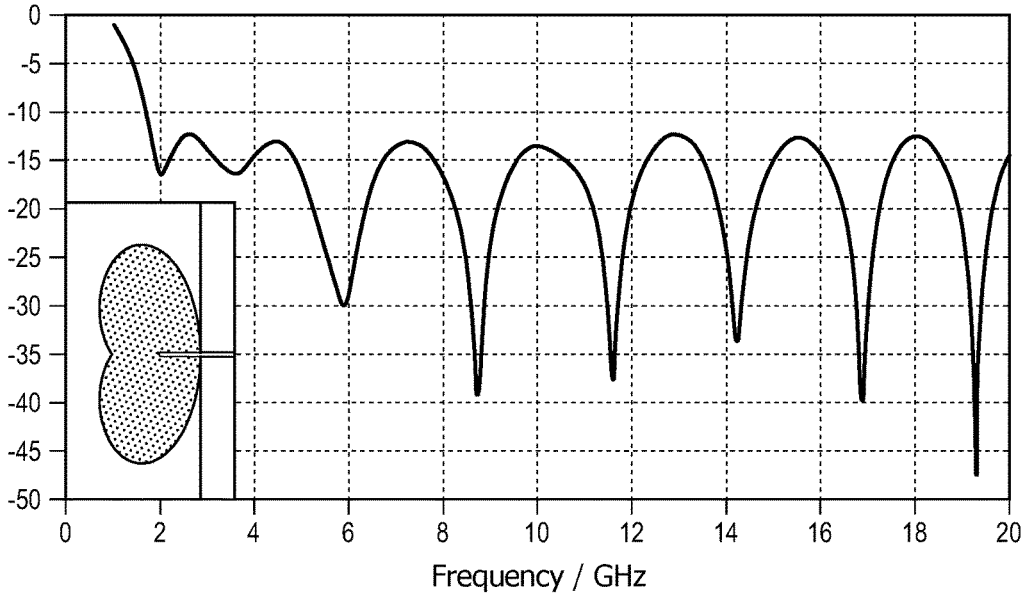

FIG. 18A and FIG. 18B show two examples of circular-like supershaped patch antennas as defined above, together with a graph of their respective wide band properties.

In the insets of the figures, the two supershapes are depicted which fulfill the conditions:

for a): $m_1=m_2=2.25$, $n_3=n_2=2.7$, a=b=1, n1=1.43, c=13.28, for b): $m_1=m_2=1.65$, $n_3=n_2=3.6$, a=b=1, n1=0.65, c=12.14.

wherein c is a scaling factor which is a factor by which the value of pd(φ) is multiplied.

The graphs show that both supershaped patch antennas achieve a magnitude of S11 around or below −10 dB over a broad frequency range from 2 to 20 GHz.

One additional advantage of this circular patch antenna in comparison to a conventional circular monopole consists in the enhanced impedance matching properties at lower frequencies. This is a remarkable improvement which results, also, in the increase of the antenna bandwidth.

Elongated Elliptical Supershape

A special elongated variation of the circular-like supershape above, is obtained based on the same basic built-up as indicated above, which differs in having the following combination of parameters:

m1=m2=1;

a=b=1;

n3 equals n2 and ranges from 1 to 10;

n1 ranges from 1 to 1.5.

A bandwidth can thereby be obtained which varies between 20 GHz and 26 GHz

Square Supershape

A square supershape is obtained based on the same basic built-up as indicated above, which differs in having the following combination of parameters:

m1 equals m2 and ranges from 3.6 to 4.5;

a=b=1;

n3=n2=3; and n1=3.

Figure 19:
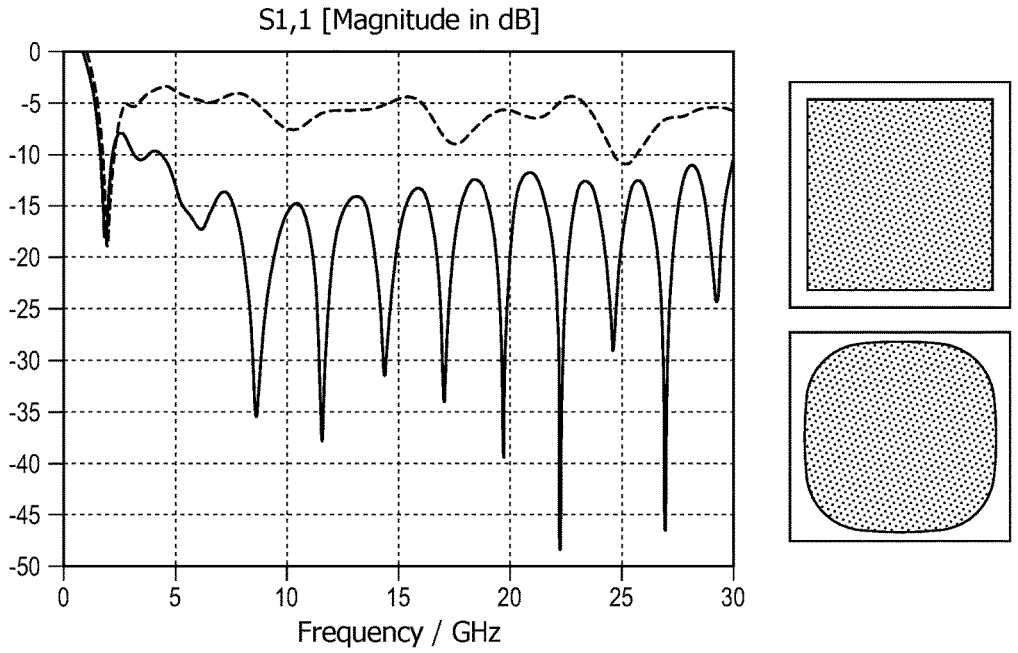

FIG. 19 shows a picture of a square supershaped patch antenna as defined above (bottom right), and a square patch antenna commonly used (top right), together with a graph of their respective wide band properties (lower line corresponds to the supershaped patch antenna).

The graph shows the square supershaped patch antenna achieves a magnitude for S11 below −10 dB over a broad frequency range from 3 to 30 GHz. In contrast, the common square patch antenna achieves such values only around 2, 17, and 25 GHz, but not over the full frequency range.

Furthermore, the square supershaped patch antenna achieves lower or similar input reflection coefficient values over the whole frequency range from 2 to 30 GHz, in comparison to the common square patch antenna.

Slotted Supershapes (1)

A slotted supershape is obtained based on the same basic built-up as indicated above, which differs in that:

the patch is provided with a slot being an excised area within the patch, wherein the patch is defined by the polar function:

$$\rho_d(\varphi) = \left(\left|\frac{1}{a}\cos\frac{m_1}{4}\varphi\right|^{n_2} + \left|\frac{1}{b}\sin\frac{m_2}{4}\varphi\right|^{n_3}\right)^{-\frac{1}{n_1}}$$

wherein the above polar function ρd(φ) is multiplied by a scaling factor c=11.16, and wherein m1=m2=2.25;

a=b=1;

n3=n2=3; and n1=1.48;

wherein the slot within the patch is defined by the polar function:

$$\rho_d(\varphi) = \left(\left|\frac{1}{a}\cos\frac{m_1}{4}\varphi\right|^{n_2} + \left|\frac{1}{b}\sin\frac{m_2}{4}\varphi\right|^{n_3}\right)^{-\frac{1}{n_1}}$$

wherein the above polar function pd((p) is multiplied by a scaling factor c=4.4, and wherein m1=m2=2.36;

a=b=1;

n3=n2=2.83; and n1=1.43.

Figure 20:
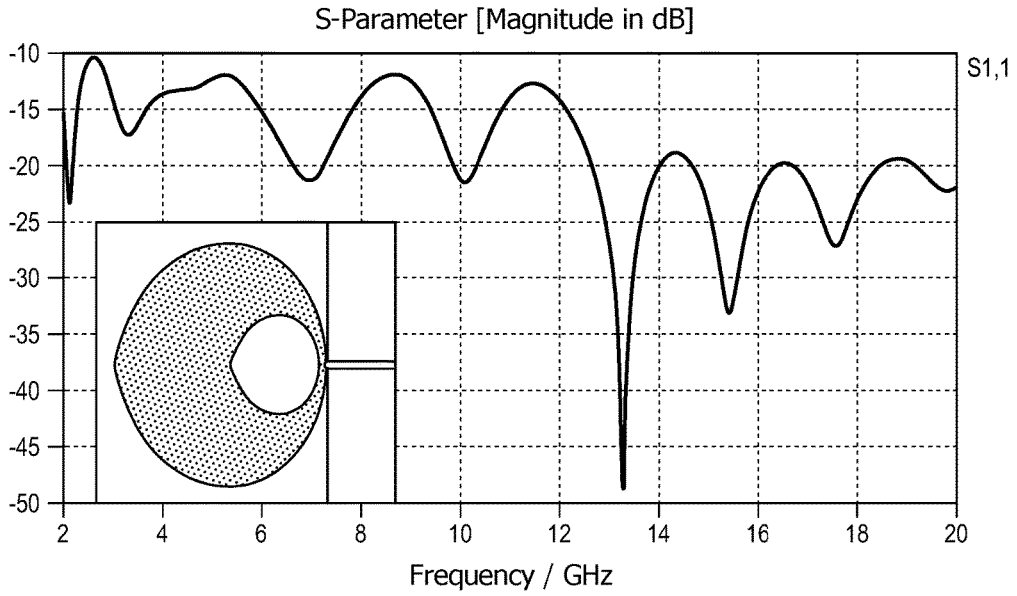

FIG. 20 shows on the inset the form of the above defined slotted supershape patch antenna, together with a diagram outlining its respective wide band properties.

Figure 21:
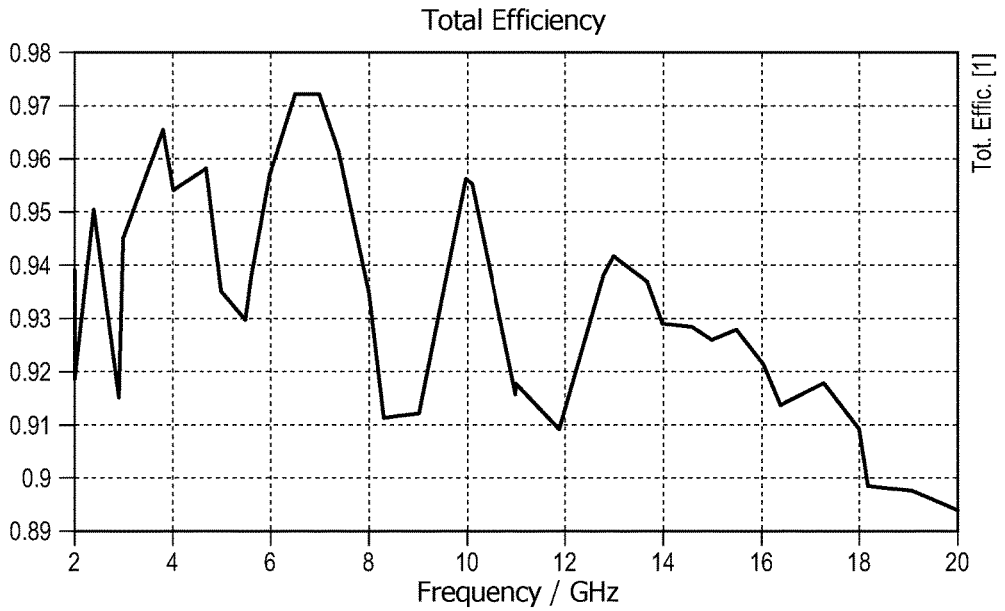

The graph shows a sufficient sensitivity over the frequency range from 2 to 20 GHz. FIG. 21 shows a graph of the efficiency of the same slotted supershape patch antenna. The efficiency is at least 90% or higher over the same frequency range.

Slotted Supershapes (2)

Other slotted supershape patch antenna designs may be contemplated for use in UWB applications.

For instance, a design wherein a secondary patch is present within the excised area of the slot within the primary patch can be effective.

Such a slotted supershape is obtained based on the same basic built-up as indicated above, wherein the patch is provided with a slot being an excised area within the patch, which differs in that:

the slot being provided with a secondary patch, the main patch, also referred to as a primary patch, said slot and said secondary patch all being defined by the polar function:

$$\rho_d(\varphi) = \left(\left|\frac{1}{a}\cos\frac{m_1}{4}\varphi\right|^{n_2} + \left|\frac{1}{b}\sin\frac{m_2}{4}\varphi\right|^{n_3}\right)^{-\frac{1}{n_1}}$$

wherein:

m1=m2=4;

a=b=1;

n3=n2=n1=3;

wherein the polar function ρd(φ) for the primary patch is multiplied by a scaling factor c1=11.2, wherein the polar function ρd(φ) for the slot is multiplied by a scaling factor c2=8, wherein the polar function ρd(φ) for the secondary patch is multiplied by a scaling factor c3=5.8.

In more general terms, the invention includes a slotted supershape as above wherein the values of c1, c2 and c3 may vary from the above values, as long as they the condition: c1>c2>c3.

Figure 22:
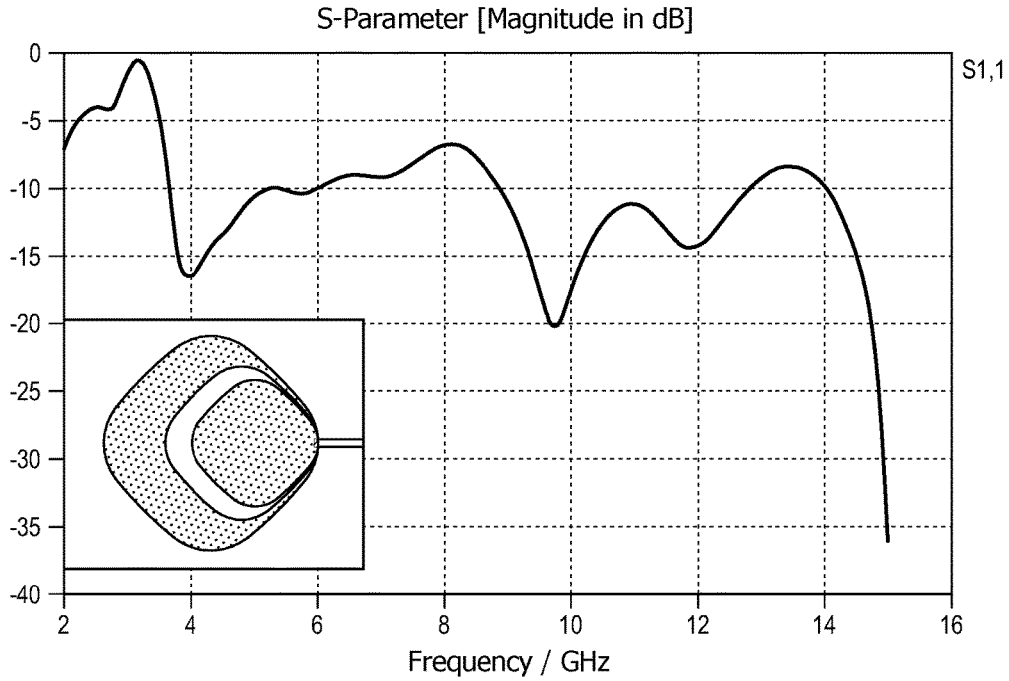

FIG. 22 shows such a slotted supershape having a primary and secondary patch, together with a graph highlighting its wide band properties.

From the graph it follows that over the range from 4 to 15 GHz, the magnitude of S11 is around or below −10 dB, as required.

It has been found that an UWB patch antenna according to the above designs may further improve on the bandwidth achieved, when the feeding structure is a microstrip line, which is provided in parallel orientation to the perpendicular symmetry plane of the patch, at a distance from said symmetry plane, said distance being larger than the width of the microstrip line.

For instance, when using a microstrip line of 0.5 to 2.0 mm width, a distance from the symmetry plane between 2.0 and 5.0 mm, can result in an increase of the bandwidth that can be 10 GHz or more, dependent on the specific base profile of the patch that is used.

FINAL REMARKS

It will be apparent that the invention is not limited to the exemplary embodiments shown and described here, but that within the scope of the appended claims numerous variants are possible which will be self-evident to the skilled person in this field. In addition, it should be appreciated based on this disclosure that this invention has numerous embodiments including numerous inventive devices, components, aspects, methods, etc. In this document, references to the "the invention" are not intended to apply to all embodiments of the invention.

This summary is meant to provide an introduction to the concepts that are disclosed within the specification without being an exhaustive list of the many teachings and variations upon those teachings that are provided in the extended discussion within this disclosure. Thus, the contents of this summary should not be used to limit the scope of the claims that follow.

Inventive concepts are illustrated in a series of examples, some examples showing more than one inventive concept. Individual inventive concepts can be implemented without implementing all details provided in a particular example. It is not necessary to provide examples of every possible combination of the inventive concepts provide below as one of skill in the art will recognize that inventive concepts illustrated in various examples can be combined together in order to address a specific application.

Other systems, methods, features and advantages of the disclosed teachings will be or will become apparent to one with skill in the art upon examination of the following figures and detailed description. It is intended that all such additional systems, methods, features and advantages be included within the scope of and be protected by the accompanying claims.

The limitations in the claims (e.g., including that to be later added) are to be interpreted broadly based on the language employed in the claims and not limited to examples described in the present specification or during the prosecution of the application, which examples are to be construed as non-exclusive. For example, in the present disclosure, the term "preferably" is nonexclusive and means "preferably, but not limited to." In this disclosure and during the prosecution of this application, means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are not recited. In this disclosure and during the prosecution of this application, the terminology "present invention" or "invention" can be used as a reference to one or more aspect within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments can include overlapping features. In this disclosure, the following abbreviated terminology can be employed: "e.g." which means "for example."

The invention claimed is:

1. A patch antenna, comprising:

at least one electrically conductive patch, at least one electrically conductive ground plane, at least one feed connector which is insulated from the at least one ground plane and which is conductively connected to the at least one patch, and at least one dielectric spacer structure for separating the at least one patch and the at least one ground plane, wherein the at least one patch is defined by at least a part of at least one base profile which is substantially supershaped, wherein said supershaped base profile is defined by the polar function:

$$\rho_d(\varphi) = \left(\left|\frac{1}{a}\cos\frac{m_1}{4}\varphi\right|^{n_2} + \left|\frac{1}{b}\sin\frac{m_2}{4}\varphi\right|^{n_3}\right)^{-\frac{1}{n_1}}$$

wherein:

$\rho_d(\varphi)$ is a curve located in the XY-plane, $\varphi \in [0, 2\pi)$ is the angular coordinate, $m1 \neq 0$ and $m2 \neq 0$, and wherein at least one of n1, n2, and n3 does not equal 2, and wherein the at least one patch is configured to operate in a broad frequency range for which the emitted signal bandwidth exceeds the lesser of 500 MHz or 20% of the center frequency, and wherein the at least one patch is defined by the polar function:

$$\rho_d(\varphi) = \left(\left|\frac{1}{a}\cos\frac{m_1}{4}\varphi\right|^{n_2} + \left|\frac{1}{b}\sin\frac{m_2}{4}\varphi\right|^{n_3}\right)^{-\frac{1}{n_1}}$$

wherein:

m1 equals m2 and ranges from 1 to 3.5;

a=b=1;

n3 equals n2 and ranges from 0.7 to 3; and n1 ranges from 0.5 to 3, and more specifically wherein:

m1 equals m2 and ranges from 1 to 3.5;

a=b=1;

combined with either:

n1=3 while n3 equals n2 and is chosen from 3, 1, and 0.7;

n1=1 while n3 equals n2 and is chosen from 3, 2.5, and 1;

n1=0.7 while n3 equals n2 and is 3; or n1=0.5 while n3 equals n2 and is 2.5.

2. The patch antenna according to claim 1, wherein the at least one feed connector is a microstrip line, which is provided in parallel orientation to the perpendicular symmetry plane of the at least one patch, at a distance from said symmetry plane, said distance being larger than the width of the microstrip line.

3. The patch antenna according to claim 1, wherein the patch antenna comprises a plurality of patches, each of which is connected to a separate feed connector.

4. The patch antenna according to claim 3, wherein the plurality of patches are positioned at a distance from each other.

5. The patch antenna according to claim 1, wherein the at least one patch connected to the at least one feed connector acts as a primary patch, and wherein the patch antenna further comprises at least one secondary patch positioned at a distance from said primary patch, such that the primary patch and the secondary patch are configured to interact electromagnetically with another.

6. The patch antenna according to claim 5, wherein the at least one primary patch and the at least one secondary patch have a combined base profile which is supershaped.

7. The patch antenna according to claim 5, wherein the at least one primary patch and the at least one secondary patch are mutually separated by at least one slot, wherein said at least one slot has a base profile which is substantially supershaped.

8. The patch antenna according to claim 1, wherein the spacer structure and/or the ground plane has a substantial circular or elliptical shape.

9. The patch antenna according to claim 1, wherein the at least one feed connector is connected to the at least one patch at an off-center position on the patch.

10. The patch antenna according to claim 1, wherein the at least one feed connector comprises a microstrip extending substantially parallel to the at least one ground plane.

11. The patch antenna according to claim 1, wherein the at least one feed connector is led through a hole provided in the at least one ground plane.

12. A method of manufacturing the antenna according to claim 1, comprising:

A) designing the at least one patch such that the at least one patch is defined by at least a part of at least one base profile which is substantially supershaped, said supershape defined by the polar function:

$$\rho_d(\varphi) = \left(\left|\frac{1}{a}\cos\frac{m_1}{4}\varphi\right|^{n_2} + \left|\frac{1}{b}\sin\frac{m_2}{4}\varphi\right|^{n_3}\right)^{-\frac{1}{n_1}}$$

wherein:

$\rho_d(\varphi)$ is a curve located in the XY-plane, $\varphi \in [0, 2\pi)$ is the angular coordinate, $m1 \neq 0$ and $m2 \neq 0$, and wherein at least one of n1, n2, and n3 does not equal 2;

B) assembling, by using a spacer structure, a ground plane, the at least one patch, and a feed connector which is insulated from the ground plane and which is conductively connected to the at least one patch, wherein the at least one patch and the ground plane are separated by the spacer structure.

13. The method according to claim 12, wherein during step B) multiple patches are attached to the substrate, wherein each patch is connected to its own feed connector.

14. A method for use in wireless communications by using a patch antenna, the method comprising the step of connecting a communication circuit to an antenna network, the network comprising a plurality of patch antennas according to claim 1, each antenna optimized for operation in at least one designated frequency band.

15. An RF transceiver of a wireless communications device comprising at least one patch antenna according to claim 1.

16. A patch antenna, comprising:

at least one electrically conductive patch, at least one electrically conductive ground plane, at least one feed connector which is insulated from the at least one ground plane and which is conductively connected to the at least one patch, and at least one dielectric spacer structure for separating the at least one patch and the at least one ground plane, wherein the at least one patch is defined by at least a part of at least one base profile which is substantially supershaped, wherein said supershaped base profile is defined by the polar function:

$$\rho_d(\varphi) = \left(\left|\frac{1}{a}\cos\frac{m_1}{4}\varphi\right|^{n_2} + \left|\frac{1}{b}\sin\frac{m_2}{4}\varphi\right|^{n_3}\right)^{-\frac{1}{n_1}}$$

wherein:

$\rho_d(\varphi)$ is a curve located in the XY-plane, $\varphi \in [0, 2\pi)$ is the angular coordinate, $m1 \neq 0$ and $m2 \neq 0$, and wherein at least one of n1, n2, and n3 does not equal 2, wherein the at least one patch is configured to operate in a broad frequency range for which the emitted signal bandwidth exceeds the lesser of 500 MHz or 20% of the center frequency, and wherein the at least one patch is defined by the polar function:

$$\rho_d(\varphi) = \left(\left|\frac{1}{a}\cos\frac{m_1}{4}\varphi\right|^{n_2} + \left|\frac{1}{b}\sin\frac{m_2}{4}\varphi\right|^{n_3}\right)^{-\frac{1}{n_1}}$$

wherein:

$m1=m2=1$;

$a=b=1$;

n3 equals n2 and ranges from 1 to 10;

n1 ranges from 1 to 1.5.

17. A patch antenna, comprising:

at least one electrically conductive patch, at least one electrically conductive ground plane, at least one feed connector which is insulated from the at least one ground plane and which is conductively connected to the at least one patch, and at least one dielectric spacer structure for separating the at least one patch and the at least one ground plane, wherein the at least one patch is defined by at least a part of at least one base profile which is substantially supershaped, wherein said supershaped base profile is defined by the polar function:

$$\rho_d(\varphi) = \left(\left|\frac{1}{a}\cos\frac{m_1}{4}\varphi\right|^{n_2} + \left|\frac{1}{b}\sin\frac{m_2}{4}\varphi\right|^{n_3}\right)^{-\frac{1}{n_1}}$$

wherein:

$\rho_d(\varphi)$ is a curve located in the XY-plane, $\varphi \in [0, 2\pi)$ is the angular coordinate, $m1 \neq 0$ and $m2 \neq 0$, and wherein at least one of n1, n2, and n3 does not equal 2, wherein the at least one patch is configured to operate in a broad frequency range for which the emitted signal bandwidth exceeds the lesser of 500 MHz or 20% of the center frequency, and wherein the at least one patch is defined by the polar function:

$$\rho_d(\varphi) = \left(\left|\frac{1}{a}\cos\frac{m_1}{4}\varphi\right|^{n_2} + \left|\frac{1}{b}\sin\frac{m_2}{4}\varphi\right|^{n_3}\right)^{-\frac{1}{n_1}}$$

wherein:

m1 equals m2 and ranges from 3.6 to 4.5;

$a=b=1$;

$n3=n2=3$; and $n1=3$.

18. A patch antenna, comprising:

at least one electrically conductive patch, at least one electrically conductive ground plane, at least one feed connector which is insulated from the at least one ground plane and which is conductively connected to the at least one patch, and at least one dielectric spacer structure for separating the at least one patch and the at least one ground plane, wherein the at least one patch is defined by at least a part of at least one base profile which is substantially supershaped, wherein said supershaped base profile is defined by the polar function:

$$\rho_d(\varphi) = \left(\left|\frac{1}{a}\cos\frac{m_1}{4}\varphi\right|^{n_2} + \left|\frac{1}{b}\sin\frac{m_2}{4}\varphi\right|^{n_3}\right)^{-\frac{1}{n_1}}$$

wherein:

$\rho_d(\varphi)$ is a curve located in the XY-plane, $\varphi \in [0, 2\pi)$ is the angular coordinate, $m1 \neq 0$ and $m2 \neq 0$, and wherein at least one of n1, n2, and n3 does not equal 2, wherein the at least one patch is configured to operate in a broad frequency range for which the emitted signal bandwidth exceeds the lesser of 500 MHz or 20% of the center frequency, and wherein the at least one patch is provided with a slot being an excised area within the at least one patch, wherein the at least one patch is defined by the polar function:

$$\rho_d(\varphi) = \left(\left|\frac{1}{a}\cos\frac{m_1}{4}\varphi\right|^{n_2} + \left|\frac{1}{b}\sin\frac{m_2}{4}\varphi\right|^{n_3}\right)^{-\frac{1}{n_1}}$$

wherein the above polar function pd((p) is multiplied by a scaling factor c1, and wherein m1=m2=2.25;

a=b=1;

n3=n2=3; and n1=1.48;

wherein the slot within the at least one patch is defined by the polar function:

$$\rho_d(\varphi) = \left(\left|\frac{1}{a}\cos\frac{m_1}{4}\varphi\right|^{n_2} + \left|\frac{1}{b}\sin\frac{m_2}{4}\varphi\right|^{n_3}\right)^{-\frac{1}{n_1}}$$

wherein the above polar function ρd(φ) is multiplied by a scaling factor c2, and wherein m1=m2=2.36;

a=b=1;

n3=n2=2.83; and n1=1.43;

and wherein c1 is larger than c2 and c2 is at least 1; and c1 is at least two times greater than c2.

19. A patch antenna, comprising:

at least one electrically conductive patch, at least one electrically conductive ground plane, at least one feed connector which is insulated from the at least one ground plane and which is conductively connected to the at least one patch, and at least one dielectric spacer structure for separating the at least one patch and the at least one ground plane, wherein the at least one patch is defined by at least a part of at least one base profile which is substantially supershaped, wherein said supershaped base profile is defined by the polar function:

$$\rho_d(\varphi) = \left(\left|\frac{1}{a}\cos\frac{m_1}{4}\varphi\right|^{n_2} + \left|\frac{1}{b}\sin\frac{m_2}{4}\varphi\right|^{n_3}\right)^{-\frac{1}{n_1}}$$

wherein:

$\rho_d(\varphi)$ is a curve located in the XY-plane, $\varphi \in [0, 2\pi)$ is the angular coordinate, $m1 \neq 0$ and $m2 \neq 0$, and wherein at least one of n1, n2, and n3 does not equal 2, wherein the at least one patch is configured to operate in a broad frequency range for which the emitted signal bandwidth exceeds the lesser of 500 MHz or 20% of the center frequency, and wherein the at least one patch is defined by the polar function:

$$\rho_d(\varphi) = \left(\left|\frac{1}{a}\cos\frac{m_1}{4}\varphi\right|^{n_2} + \left|\frac{1}{b}\sin\frac{m_2}{4}\varphi\right|^{n_3}\right)^{-\frac{1}{n_1}}$$

wherein:

m1=m2=1;

a=b=5.321;

n3=n2=1.188; and n1=0.458.

* * * * *